US011391060B2

(12) United States Patent
McLeod et al.

(10) Patent No.: US 11,391,060 B2
(45) Date of Patent: Jul. 19, 2022

(54) WEATHER RESISTANT LOCK

(71) Applicant: 2603701 ONTARIO INC., Toronto (CA)

(72) Inventors: John McLeod, Toronto (CA); Tonino Sabelli, Oakville (CA)

(73) Assignee: 2603701 ONTARIO INC., Etobicoke (CA)

( * ) Notice: Subject to any disclaimer, the term of this patent is extended or adjusted under 35 U.S.C. 154(b) by 411 days.

(21) Appl. No.: 16/199,737

(22) Filed: Nov. 26, 2018

(65) Prior Publication Data

US 2019/0292813 A1 Sep. 26, 2019

Related U.S. Application Data

(63) Continuation-in-part of application No. 15/050,709, filed on Feb. 23, 2016, now abandoned.

(30) Foreign Application Priority Data

Feb. 9, 2016 (CA) ..... CA 2920469

(51) Int. Cl.
*E05B 17/00* (2006.01)
*E05B 17/14* (2006.01)
(Continued)

(52) U.S. Cl.
CPC ..... *E05B 17/002* (2013.01); *E05B 15/16* (2013.01); *E05B 17/142* (2013.01);
(Continued)

(58) Field of Classification Search
CPC ..... E05B 15/00; E05B 15/06; E05B 15/16; E05B 17/00; E05B 17/002; E05B 17/14;
(Continued)

(56) References Cited

U.S. PATENT DOCUMENTS 2,747,397 A * 5/1956 Jacobi ..... E05B 17/181 70/455
2,977,786 A 4/1961 Kendrick et al.
(Continued)

FOREIGN PATENT DOCUMENTS

JP 3120676 B2 12/2000
JP 3173759 B2 6/2001
(Continued)

*Primary Examiner* — Christopher J Boswell
(74) *Attorney, Agent, or Firm* — Squire Patton Boggs (US) LLP

(57) ABSTRACT

A weather resistant tumbler lock has an elongated body, and defines a longitudinal axis. The lock is interchangeable with another lock having a corresponding asymmetrical perimeter profile with an opening in a top surface sealed with a cap, the other lock having a different rotatable core and a different configuration of tumblers. A drainway provides a channel for water to flow outwardly from the interior of a shell housing, a rotatable core and a keyway within the core, to a drain below the lock. The drain connects to a channel through a lower edge. The core provides an arcuate gap in a lower quadrant adjacent the interior surface of the shell for fluid communication with the drainway. A method includes identifying a substitute tumbler lock with an impermeable outer wall for replacing another lock having an identical outer perimeter profile and a permeable closed opening on its top surface.

25 Claims, 20 Drawing Sheets

(51) Int. Cl.

| | |
|---|---|
| ***E05B 27/00*** | (2006.01) |
| ***E05B 29/00*** | (2006.01) |
| ***E05B 63/00*** | (2006.01) |
| ***E05B 65/02*** | (2006.01) |
| ***E05B 65/52*** | (2006.01) |
| ***E05C 3/04*** | (2006.01) |
| ***E05B 17/18*** | (2006.01) |
| ***E05B 15/16*** | (2006.01) |
| ***E05B 65/44*** | (2006.01) |

(52) U.S. Cl.
CPC ..... *E05B 17/181* (2013.01); *E05B 27/0003* (2013.01); *E05B 29/00* (2013.01); *E05B 63/0056* (2013.01); *E05B 65/02* (2013.01); *E05B 65/44* (2013.01); *E05B 65/52* (2013.01); *E05C 3/042* (2013.01); *E05Y 2900/602* (2013.01)

(58) Field of Classification Search
CPC .... E05B 17/142; E05B 17/18; E05B 27/0003; E05B 27/007; E05B 27/0014; E05B 29/00; E05B 63/056; E05B 65/02; E05B 65/44; E05B 65/52; E05B 17/181; E05B 63/0056; E05C 3/042; E05Y 2900/602
See application file for complete search history.

(56) References Cited

U.S. PATENT DOCUMENTS

| | | | | |
|---|---|---|---|---|
| 3,754,423 | A * | 8/1973 | Seidewand | E05B 17/188 70/455 |
| 4,006,616 | A * | 2/1977 | Rubner | E05B 17/181 70/455 |
| 4,349,722 | A * | 9/1982 | Kurth | E05B 77/34 70/431 |
| 4,423,611 | A * | 1/1984 | Neyret | E05B 17/181 70/455 |
| 4,671,090 | A | 6/1987 | Masaki et al. | |
| 4,841,758 | A | 6/1989 | Ramblier | |
| 5,431,034 | A | 7/1995 | Fann et al. | |
| 5,467,624 | A | 11/1995 | Myers | |
| 5,586,459 | A | 12/1996 | Bullock et al. | |
| 5,640,864 | A | 6/1997 | Miyamoto | |
| 5,752,400 | A | 5/1998 | Kim | |
| 6,209,369 | B1 * | 4/2001 | Freck | E05B 17/002 70/455 |
| 6,439,016 | B1 | 8/2002 | Wittwer et al. | |
| 6,698,264 | B1 | 3/2004 | Liao | |
| 6,711,924 | B2 * | 3/2004 | Ritz | E05B 17/0058 70/422 |
| 6,951,123 | B2 | 10/2005 | Chong | |
| 7,003,994 | B2 | 2/2006 | Ruan | |
| 7,194,876 | B1 | 3/2007 | Pacheco et al. | |
| 7,401,484 | B1 * | 7/2008 | Holmes | E05B 17/185 70/455 |
| 8,707,746 | B1 | 4/2014 | Liu | |
| 8,739,587 | B2 | 6/2014 | Chen | |
| 8,978,426 | B2 | 3/2015 | Wang | |
| 9,003,845 | B2 | 4/2015 | Boesel et al. | |
| 9,010,163 | B2 | 4/2015 | Romero | |
| 9,260,884 | B2 | 2/2016 | Li et al. | |
| 9,482,036 | B2 | 11/2016 | Linden et al. | |
| 2001/0027671 | A1 | 10/2001 | Davis | |
| 2001/0047673 | A1 * | 12/2001 | Schwab | E05B 17/181 70/423 |
| 2002/0108407 | A1 | 8/2002 | Zapushek | |
| 2002/0189309 | A1 | 12/2002 | Stemmerik | |
| 2003/0089149 | A1 | 5/2003 | Suzuki et al. | |
| 2003/0136162 | A1 | 7/2003 | Sutton et al. | |
| 2008/0276666 | A1 | 11/2008 | Irwin et al. | |
| 2011/0067465 | A1 | 3/2011 | Luo | |
| 2014/0013813 | A1 | 1/2014 | Le | |
| 2017/0226773 | A1 * | 8/2017 | McLeod | E05B 17/181 |
| 2019/0383058 | A1 * | 12/2019 | Misner | E05B 19/0052 |
| 2020/0299996 | A1 * | 9/2020 | Tartal | E05B 17/185 |

FOREIGN PATENT DOCUMENTS

| | | |
|---|---|---|
| JP | 2009-114684 A | 5/2009 |
| JP | 2013-028906 A | 2/2013 |

* cited by examiner

PRIOR ART

PRIOR ART

PRIOR ART

PRIOR ART

WEATHER RESISTANT LOCK

CROSS REFERENCE TO RELATED APPLICATION

This is a Continuation-in-Part of U.S. patent application Ser. No. 15/050,709 filed Feb. 23, 2016, and which claims priority from Canadian Patent Application No. 2,920,469, dated Feb. 9, 2016. The contents of these applications are hereby incorporated by reference.

FIELD OF THE INVENTION

The present invention relates to keyed tumbler locks including pin tumbler locks, wafer tumbler locks, disc tumbler locks and other cylinder lock designs and to a method of providing weather resistant features which are desirable for outdoor use.

BACKGROUND

As an example, known pin tumbler locks are prone to weather related failure, corrosion, water penetration and other weather related problems. U.S. patent application Ser. No. 12/004,856 filed on Dec. 21, 2007 and published under publication number 2008/0276666 and issued to patent under U.S. Pat. No. 9,273,487 is an example of one such available pin tumbler lock.

See FIGS. 1-3 and 7 of the present application which illustrate the features of one example of a prior art pin tumbler lock used in mailboxes including outdoor mailbox applications. FIG. 7 illustrates a rear view of a simplified profile 200 of a prior art pin tumbler lock, viewed from the distal end of the prior art pin tumbler lock assembly 100. When this lock design is installed in locations which are exposed to outdoor weather conditions, there are a number of potential weather related issues.

By way of example, when installed in outdoor locations, such locks are prone to freezing particularly during weather conditions including temperature changes from rain to freezing rain or snow. With regard to the prior art drawings, FIGS. 1-3 and particularly FIG. 1, water ingress is often a problem from:

- The front of the prior art pin lock between keyhole 125 and dust cover 119 and between cylinder 101 and plug cap 123 in prior art pin tumbler lock assembly 100; and
- The top of the prior art pin lock at the interface between the spring retainer 117 and the surrounding edge of the prior art cylinder 101. Furthermore, the shape of the top rear of cylinder 101 allows water dripping down from the mail compartment door to be biased towards spring retainer 117. The spring retainer 117 is made from flat bar material. Spring retainer 117 is held in place by crimping the surrounding edge of the cylinder 101 to form an overlapping lip from the cast metal used to make the cylinder 101. Often, tolerances are such that water can easily pass around and under the lip and around the edges of spring retainer 117, into the pin chambers below.

The rear of the prior art pin lock may also experience water ingress between cylinder 101 and plug 103. The dust cover 119 frequently does not fully close when dust, dirt or ice is present. The upper and lower pivot points of dust cover 119 are square and do not promote easy or smooth pivoting of the door. Water may pool at the lower pivot point which in turn may freeze and hinder movement of the dust cover.

Under these circumstances, water may freeze and render the lock inoperable. By way of further example:

- Pins 113, retainer 126 and springs 115 may freeze in the pin chambers thus preventing the key from turning;
- Ice may build up in cylinder 101 to prevent plug 103 from rotating. With regard to FIG. 2, stop 601 may prevent cylinder 101 from rotating if ice builds-up in stop chamber 602 which is positioned at the bottom of cylinder 101 where water and ice may accumulate;
- Ice may build up in keyway 127 so that the key cannot be fully inserted; and
- Ice may build up at the bottom of dust cover 119 and so that the dust cover will not open.

In some cases, customers may bend the dust cover 119 when ice builds up at the bottom of dust cover 119 and the cover won't open when force is applied with a key. A customer faced with ice build-up may firmly push on key 111 with sufficient force to bend the door near the lower pivot point. Deformation of the dust cover may prevent the dust cover from subsequently operating correctly and it may become necessary to replace the prior art pin lock.

Prior art locks may also be prone to corrosion or other water/ice related damage because of water penetration and accumulation within those locks.

There is a need for a suitable lock design with weather resistant features for use in outdoor applications.

Introduction to the Invention

The invention includes an improved, weather resistant, keyed cylindrical lock design which may be applied to pin tumbler locks, wafer tumbler locks, disc tumbler locks and other keyed lock designs. Various embodiments and aspects of the invention will be apparent to persons skilled in the art, upon reading the entirety of this specification, including the description, drawings and claims appended hereto. The following introduction is meant to provide an overview of the invention, without limiting the invention to the specific aspects and features which are described in general terms for illustration of some examples of the invention.

In one embodiment, a keyed cylindrical tumbler activated lock extends along a longitudinal axis from an outer face at a proximate end to a distal end. The cylindrical lock includes a shell extending between the proximate and distal ends. The shell houses a rotatable cylindrical core. The core rotates within an interior chamber defined by the shell. In some embodiments, such as a pin tumbler lock, the shell defines an elevated pinway extending along the longitudinal axis. The elevated pinway extends upwardly to a top wall from an intermediate edge defined by the shell. The elevated pinway is bounded by first and second opposed vertical side walls and a vertical end wall extending between the first and second opposed side walls. The end wall is adjacent the distal end of the pin lock. The rotatable core defines a first linear plurality of pin slots communicating with the keyway when an operating key is inserted into the keyway. The elevated pinway defines a second linear plurality of pin slots in opposing relation to the first plurality of pin slots defined by the rotatable core. A first set of pins is held in the first linear plurality of pin slots abutting in coplanar interfacial alignment with a second set of pins in the second linear plurality of pin slots. When the key is inserted and the lock is in the first position, the core is allowed to rotate, about the axis, within the shell.

In this example, a hood is secured above the elevated pinway. The hood, which may take the form of a top cap, defines a rigid water barrier enclosing the second set of pins in the second linear array of pin slots. The hood extends downwardly from the top wall to the intermediate edge, and about the vertical side walls and the end wall. Preferably, the hood is secured to the elevated pinway along a band adjacent the intermediate edge.

In some aspects of the invention, a band defined by an interior surface of the hood projects inwardly to secure the hood to the elevated pinway. The band may be formed by crimping a lower edge of the hood for secure engagement along the intermediate edge of the elevated pinway. The hood may also be crimped to form the band at the intermediate edge of the elevated pinway.

In some embodiments, the intermediate edge is adjacent to a bottom edge of the elevated pinway, extending along a shoulder defined by a bottom portion of the shell.

Some aspects of the invention may feature an interior drainway which extends downwardly and outwardly from within the tumbler lock, for example, a pin tumbler lock. The drainway may extend below an access door to the keyway which is pivotably mounted between the outer face and the keyway. Preferably, a drainway is provided to promote the flow of water outwardly and downwardly via a sloped channel and connected drain opening. The drainway may define a pathway for water to flow outwardly from the shell, the rotatable core, the access door, and an (optional) outer face ring which covers the face of the shell (if a face cover is provided) while surrounding the keyway. The access door may be pivotably mounted on a post extending between a top recess in a frame and a bottom recess in the frame. The bottom of the access door may define an elevated bottom edge which travels above an adjacent surface defined by the frame or a bottom edge of a recess within the face of the rotatable core. The elevated edge may define a clearance gap above the adjacent surface when the access door pivots within the frame. The post may be rotatable relative to the frame and the access door.

A detent may be featured adjacent the intermediate edge, between the interior surface of the hood and an adjacent surface of the elevated pinway to more securely fasten the hood to the elevated pinway. The hood may be crimped, press-fit, snap-fit, slide-fit or the band may be formed in another manner to provide secure engagement with the detent.

By way of further example, the detent may be an elevated ridge or a recess adjacent the intermediate edge.

In another aspect, the pin tumbler lock comprises an outer face ring at a proximate end. The pin lock includes a shell defining an elongated body extending along a longitudinal axis between the proximate end and the distal end. The shell houses a rotatable core adapted for connection to a driver, cam or other component of a lock mechanism. The shell defines an elevated pinway extending along the longitudinal axis. The elevated pinway extends upwardly to a top wall from an intermediate edge extending from a pair of opposed shoulders defined by the shell. The elevated pinway comprises: a first vertical side wall, a second vertical side wall opposite to the first vertical side wall, and a vertical end wall extending between the first and second side walls, the end wall being adjacent the distal end. The elevated pinway defines a first set of pins in a first linear plurality of pin slots through the top wall and vertically opposed to a second set of pins in a second linear plurality of pin slots defined by the rotatable core, the first and second linear plurality of pin slots being vertically aligned and communicating with a keyway in the rotatable core when an operating key is inserted into the keyway when the lock is in a first position. An interior drainway extends downwardly and outwardly from within the pin lock. The drainway comprises a channel along the bottom interior of the shell, and a dripway from the keyway in communication with the channel. The dripway extends along an access door to the keyway and along a proximate lower edge of the shell, for water to flow outwardly via a drain opening. The access door rotates about a post pivotably mounted within a frame between the outer face and the keyway when the access door is pushed away from the keyway upon entry of the operating key into the keyway. The access door may be elevated to define a gap upon rotation above a bottom ledge of the frame. A hood defines a rigid water barrier closing the first linear array of pin slots in the top wall. Preferably, the first set of pins are biased inwardly from a top interior surface of the hood toward the rotatable core. The hood may extend downwardly from the top wall to the intermediate edge, and about the first and second vertical side walls and the end wall, and when the hood is engaged with the elevated pinway, a band defined by an interior surface of the hood projects inwardly to secure the hood to the elevated pinway.

In some aspects, the band may project between the hood and the elevated pinway to secure the hood to the pinway. The hood may be glued or otherwise affixed with adhesive, crimped, press-fit, snap-fit, slide fit or assembled in some other manner, into secure engagement between the band and the elevated pinway. The band may be formed by crimping the hood into secure engagement with a detent defined by the elevated pinway.

In some other aspects, the drainway may define a pathway for water to flow outwardly from the interior of the shell, the interior of the rotatable core, the access door, and an outer face ring surrounding the keyway. In some aspects, a water resistant seal is provided at the proximate end between the outer face ring and the shell or at the distal end to inhibit water ingress between the rotatable core and the shell. Preferably, the pin lock includes water resistant seals at the proximate end and the distal end to minimize water ingress.

In other preferred aspects of the invention, the drainway includes a drainway opening, for example, a channel within the head of the core and extending downwardly, in communication with an exterior elongated channel opening. The exterior elongated channel opening extends partially along the bottom of the shell (and optional face covering if provided), beginning inwardly of the face and ending offset outwardly from the vertical outer face of a storage structure in which the lock is secured. In the preferred embodiment, the exterior elongated channel is configured as a slot extending toward the outer face of the storage structure but sufficiently offset from the face of the storage structure to inhibit water from dripping or running along the face of the storage structure. When the rotatable cylindrical core is in its locked position, the drainway is oriented at the bottom of the shell, in alignment so that the drainway opening aligns within the exterior elongated channel opening (for example a slot), to enhance outward and downward flow of water away from the interior of the lock via the drainway. Where the drainway includes an elongated drainage outlet opening, the lower outer edge of the outlet may define a drip edge to further enhance downward flow of water, away from the interior of the lock.

The head of the rotatable core preferably includes an arcuate recess extending within the lower right quadrant (between the 3 o'clock and 6 o'clock position, for example, in cylindrical locks unlocked by rotating clockwise 90 degrees) or the lower left quadrant (between the 6 o'clock and 9 o'clock position, for example, in cylindrical locks unlocked by rotating counterclockwise 90 degrees). The arcuate recess provides a gap between the rotatable core and the stationary shell to take up accumulated water, ice formed from undrained water, and pieces of ice or other debris when the cylindrical core is rotated in cold weather or other adverse conditions. When the core is rotated, the frozen undrained residue, ice particles or other debris may reside within the arcuate head space, to reduce the torque needed to operate the rotatable core. Preferably, the arcuate head space is configured to define a downwardly and outwardly sloped drainway segment when the cylindrical core is in the locked position.

In another preferred embodiment, a tumbler lock is provided in which the shell has an asymmetrical profile extending across the longitudinal axis. The tumbler lock may be used as a retrofit replacement (or as an OEM part) for another shell having a corresponding asymmetrical profile when viewed across the longitudinal axis extending along the length of the tumbler lock. The tumbler lock of the present invention may be used to replace another lock having a shell comprising a top surface with an opening sealed with a cap (see for example, the pin lock illustrated in U.S. Pat. No. 9,273,487 shown with a flat pin retainer atop an elevated pinway). In this example, the substitute lock of the present invention may be used to provide improved resistance to water ingress into a locking system including the substitute lock. The substitute lock comprises a shell defining a solid waterproof outer perimeter surface extending about and along the longitudinal axis. The outer perimeter surface comprises a solid waterproof top surface extending along the longitudinal axis. The top surface may be provided on an elevated rail defining a portion of the solid waterproof outer perimeter wall extending around the longitudinal axis.

In this aspect of the substitute lock, the shell defines an asymmetrical profile extending across a mid portion of the longitudinal axis. The shell includes a solid waterproof outer perimeter wall extending about and along the longitudinal axis. The outer perimeter wall comprises an upwardly projecting rail comprising a solid waterproof top surface. The rail extends downwardly to a base. The base extends outwardly from the rail along opposed shoulders. Each shoulder extends downwardly along a corresponding side wall of the waterproof outer perimeter to a rounded bottom, outer shell wall.

In the substitute lock, the rotatable core and the interior chamber of the shell may be configured to provide a different array of tumblers, for example, wafer locks in place of pin tumblers. In one of the preferred aspects, the substitute lock may comprise an upper course of tumblers engaging an upper channel in the shell when the core is in the locked position. An opposite lower course of tumblers may be provided to engage a portion of the drainway extending along a lower interior surface of the shell. The tumblers may be configured as wafers biased for outward projection from the rotatable core when the core is in the locked position.

In one aspect, the substitute lock comprises a shell which is configured for interchangeable use in place of another lock having a shell with a corresponding asymmetrical perimeter profile. Although the substitute lock may have a corresponding asymmetrical profile for interchangeabligity with the other lock, the substitute lock may be configured with a different core chamber within the shell for housing a different rotatable core having a different array of tumblers, different tumbler configurations, and other different internal features. For example, a user may wish to substitute a wafer lock for a pin lock in an existing locking system, Such interchangeability may be particularly beneficial in retrofit applications where a user wishes to substitute a new tumbler lock design for a worn or broken locking core and shell but to preserve and continue to use an existing locking system. This aspect may also be beneficial in certain OEM applications.

In a preferred embodiment, the lock comprises a stainless steel MIM core rotating within a shell, typically cast from zinc or other corrosion inhibiting alloys.

The invention also comprises storage structures which have been provided with a tumbler lock having one or more of these features.

The invention also includes a method of inhibiting water accumulation within a tumbler lock in a locking system. In one aspect, the method comprises identifying a substitute tumbler lock with a solid water impermeable outer wall for replacing another lock having a corresponding outer perimeter profile and a water permeable closed opening on its top surface. The substitute tumbler lock with its solid water impermeable outer wall replaces the other tumbler lock with the corresponding outer perimeter profile for operative engagement with a locking system in a storage structure.

In another aspect, the invention includes providing a drainway to channel water outwardly from the tumbler lock.

In another aspect, the method may include providing a first rotatable core in the substitute tumbler lock with a tumbler configuration which is different from the tumbler configuration of the lock being replaced.

Other aspects of the invention will become apparent upon a review of the appended drawings and the following detailed description of preferred embodiments of the invention.

Preferred embodiments of the invention will be described in detail having regard to the appended drawings. However, it will be understood that these examples illustrate certain embodiments of the invention and that the illustrated examples are not to be interpreted as limiting the scope of the invention. Persons skilled in the art will understand that the invention may be implemented for use in other forms, systems, and methods and that many other variations, modifications and embodiments fall within the scope of the invention.

THE DRAWINGS

Figure 10:
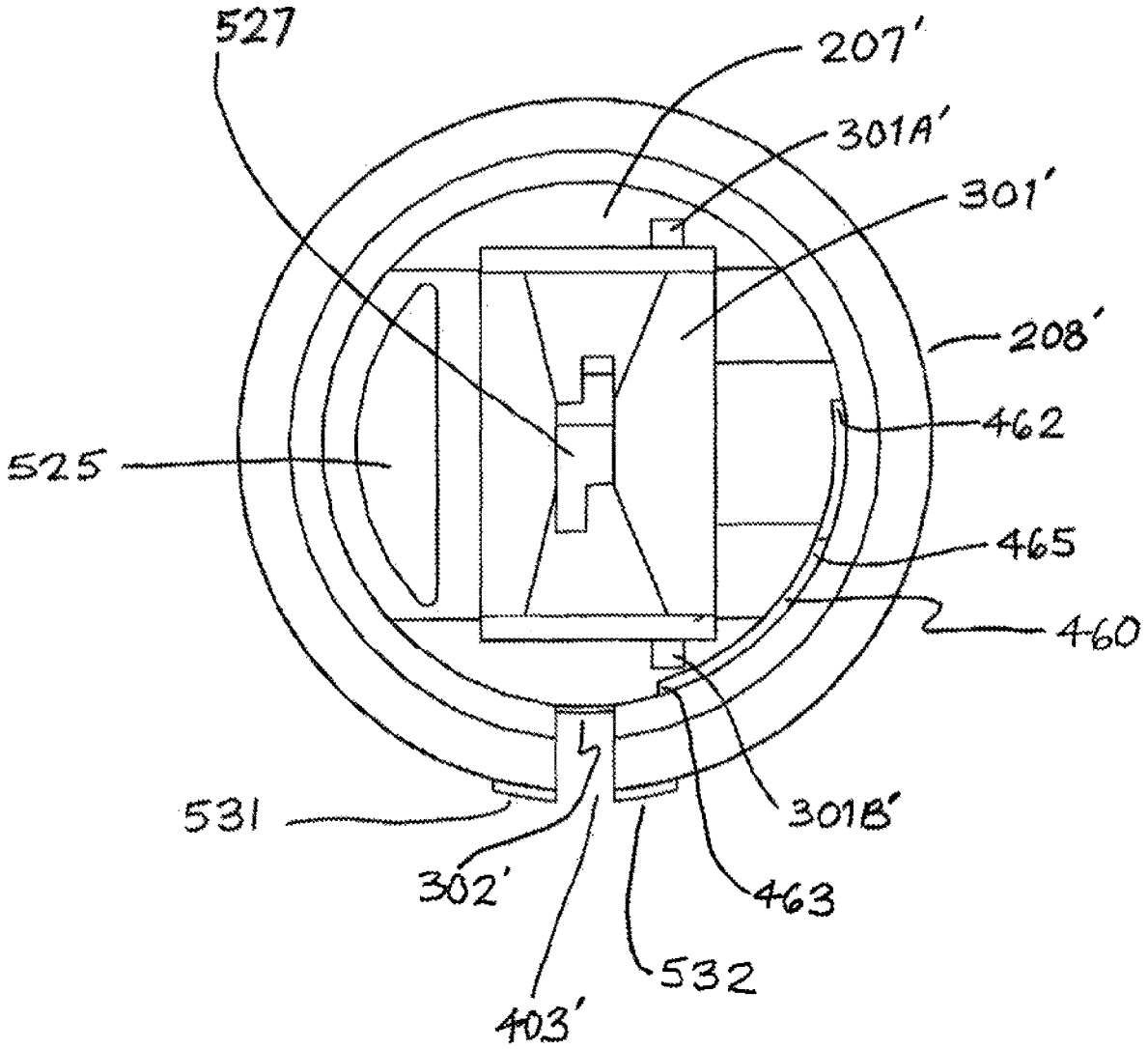
FIG. 10 is a frontal view of the core shown in FIGS. 8 and 9, inserted into the shell of this embodiment, viewed from the proximate end of the combined core and shell.
Figure 11:
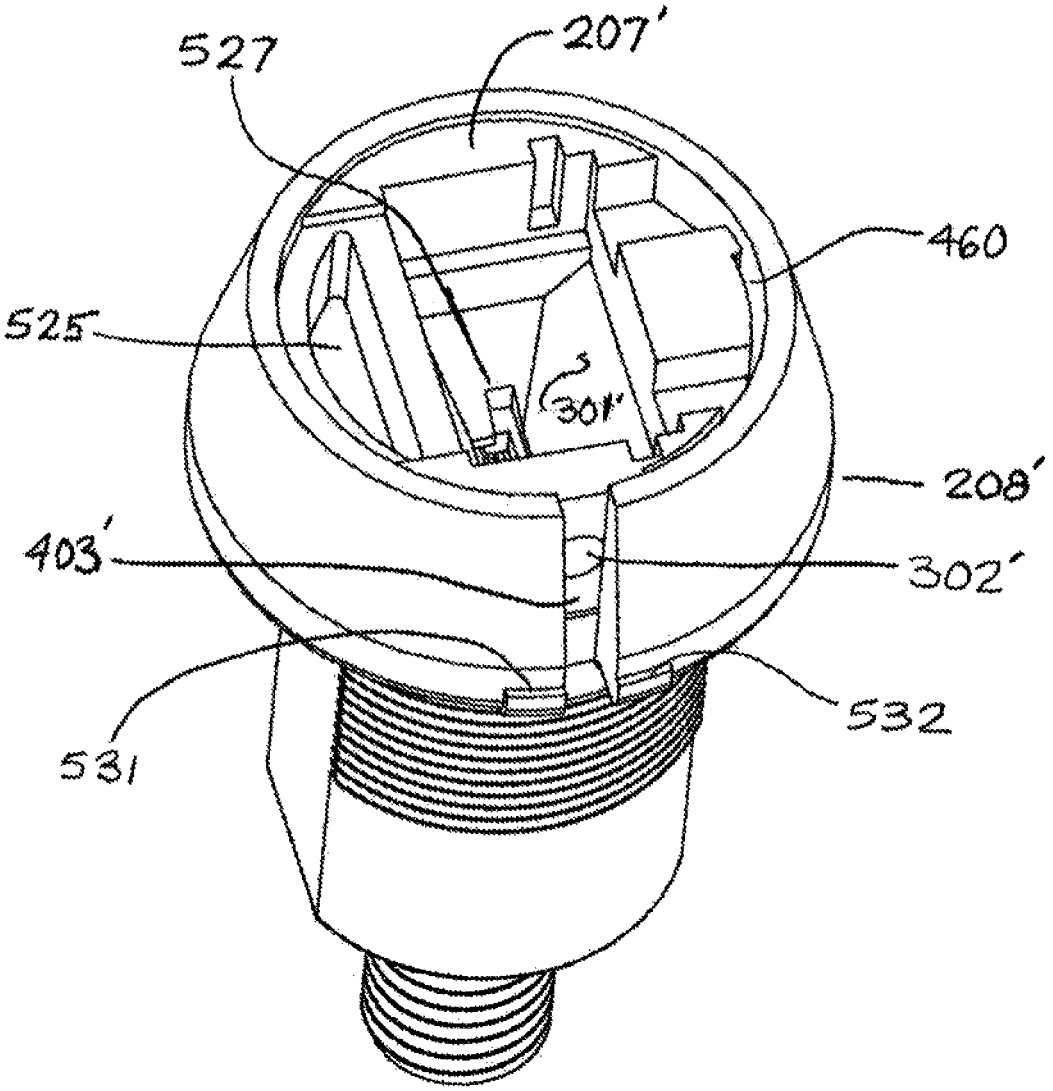
FIG. 11 is a frontal view, in perspective, of the bottom of the combined core and shell of FIG. 10, viewed from the proximate end.
Figure 12:
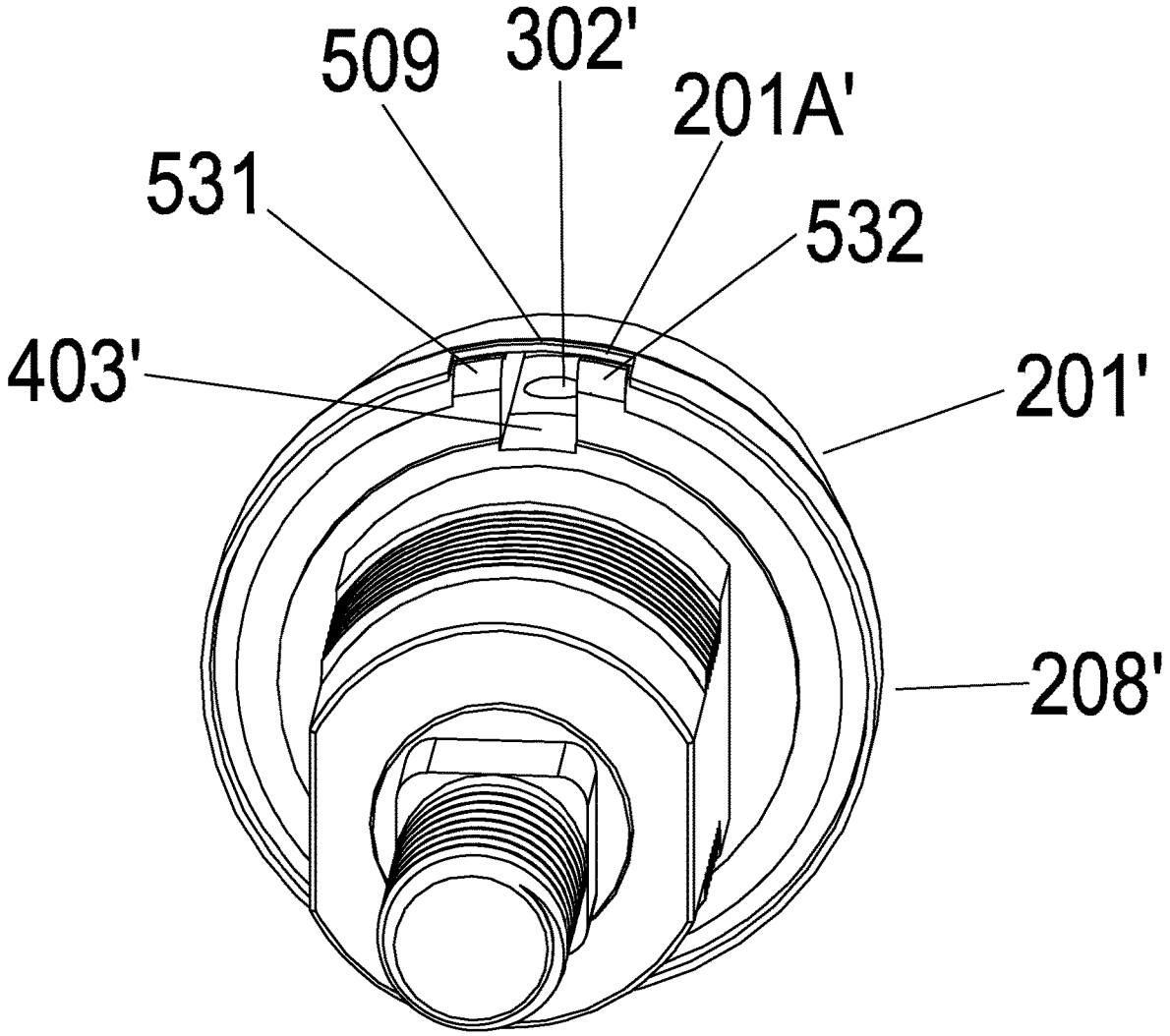
Figure 13:
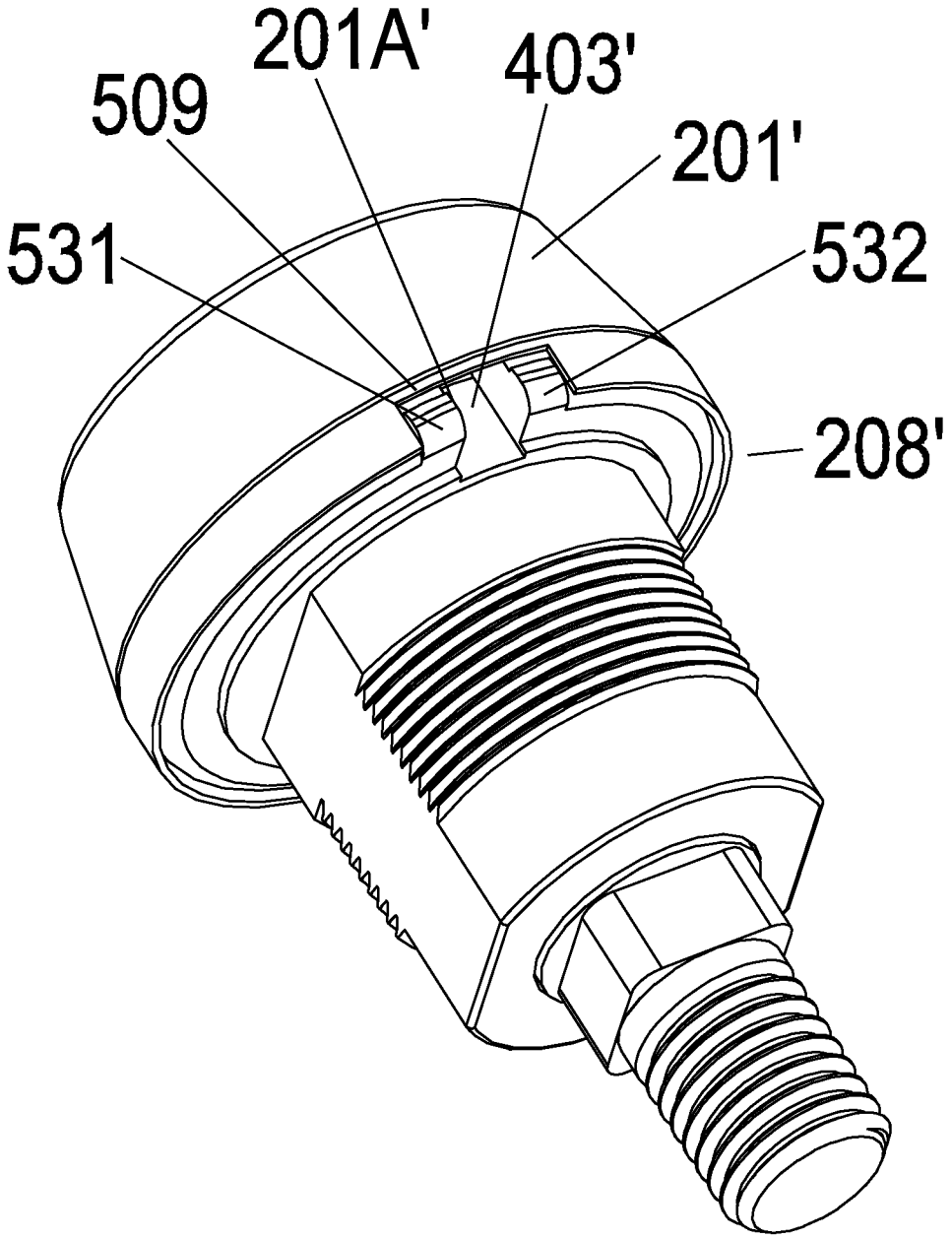
Figure 14:
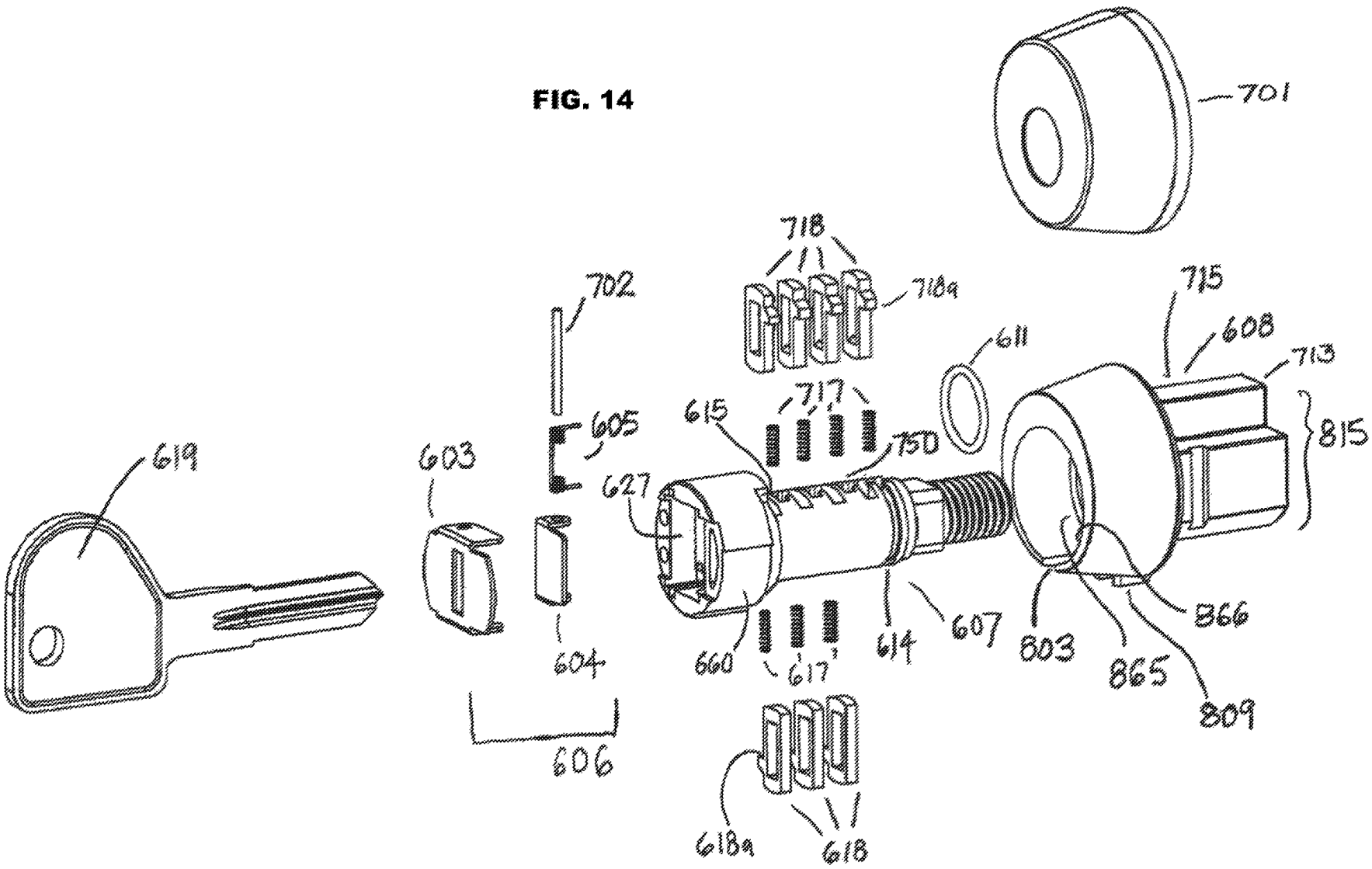
Figures 15A, 15B:
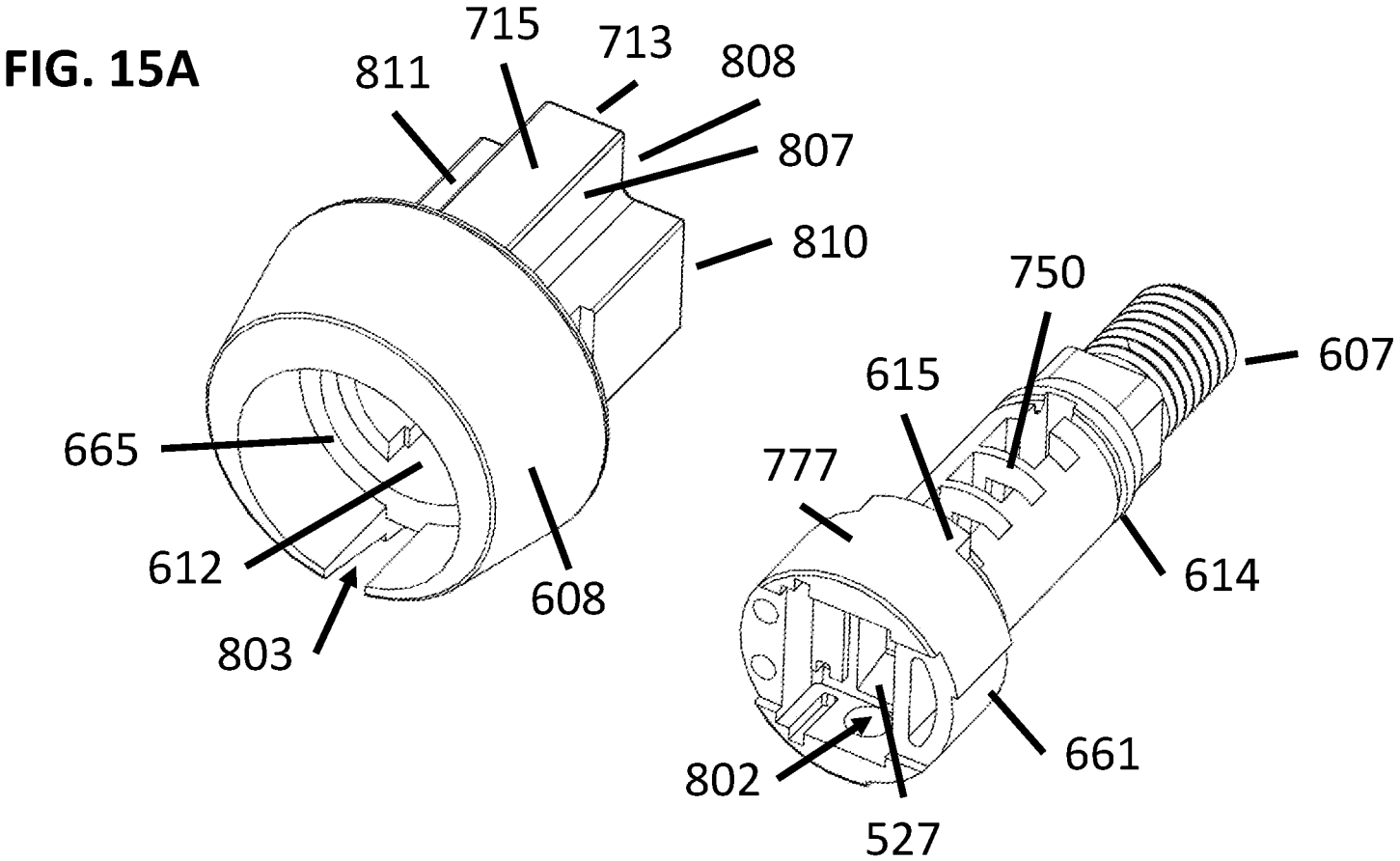
Figure 16:
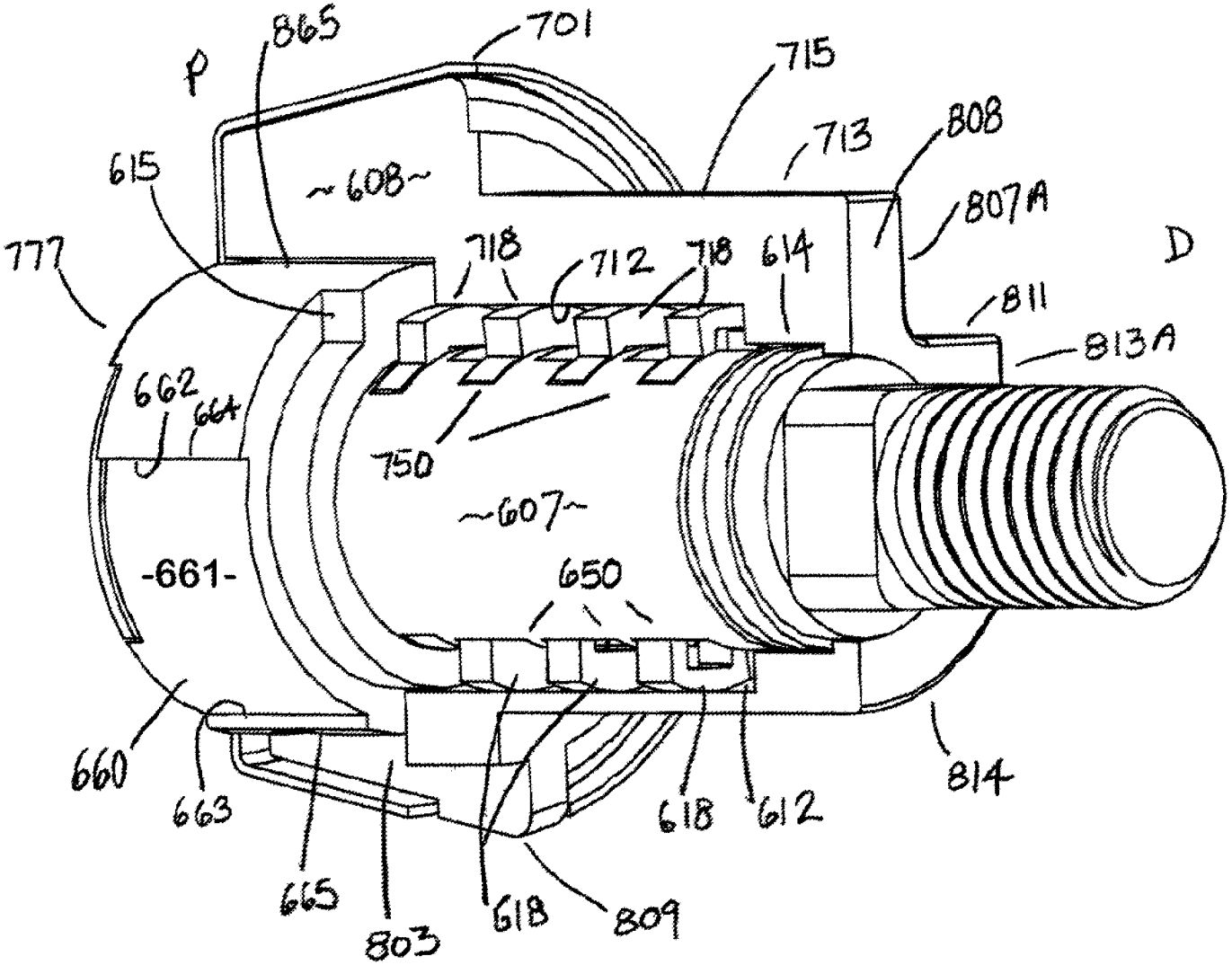
Figure 17:
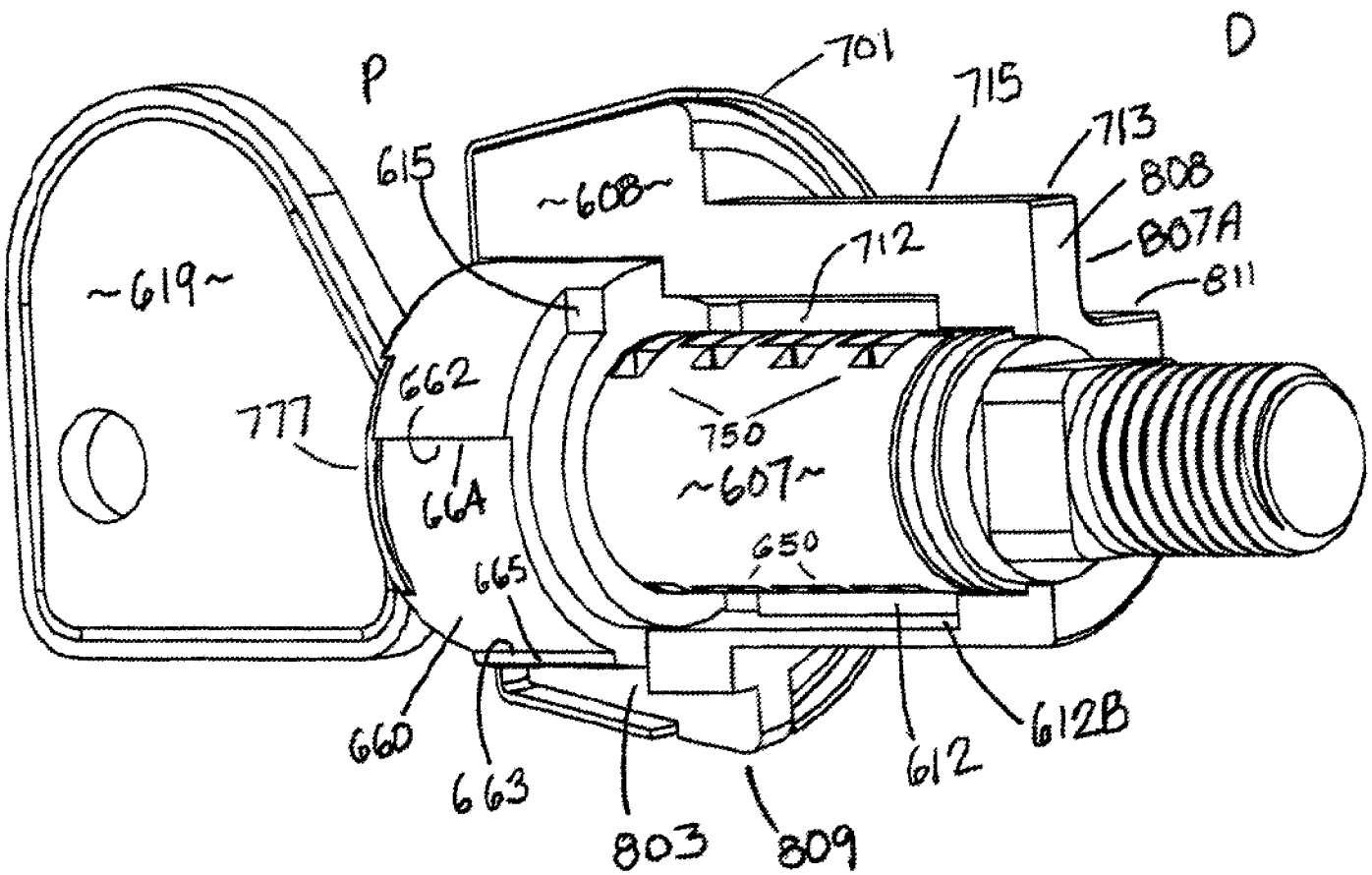
Figure 18B:
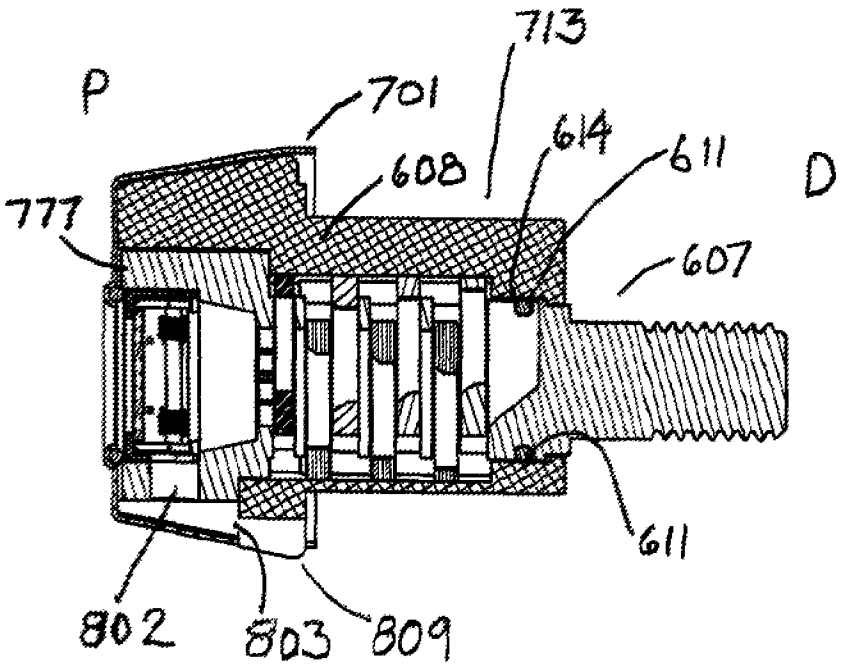
Figure 18A:
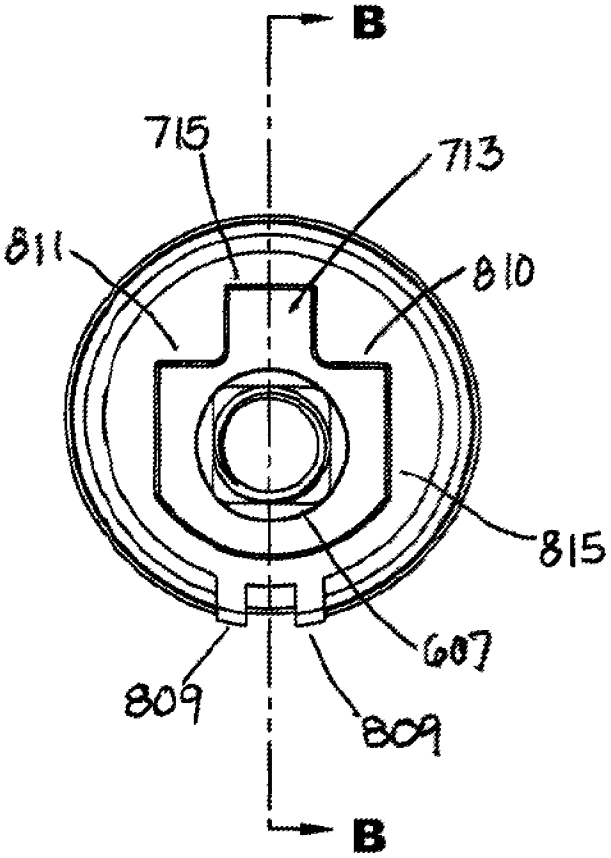
Figure 19B:
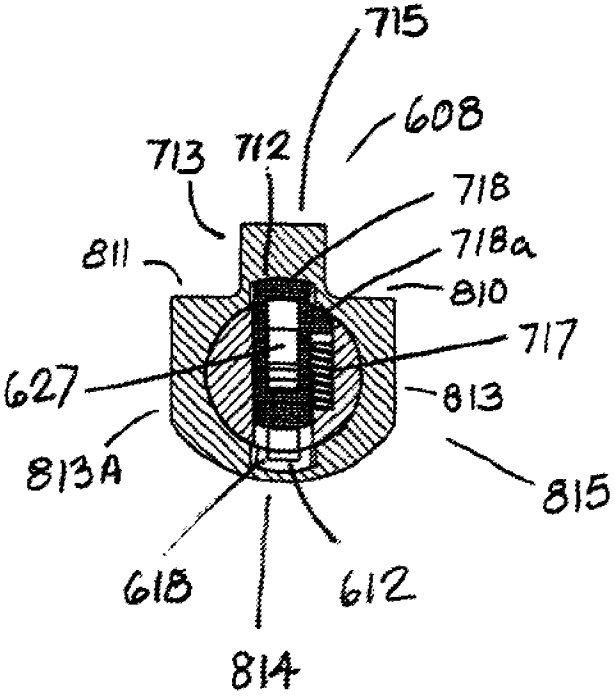
Figure 19A:
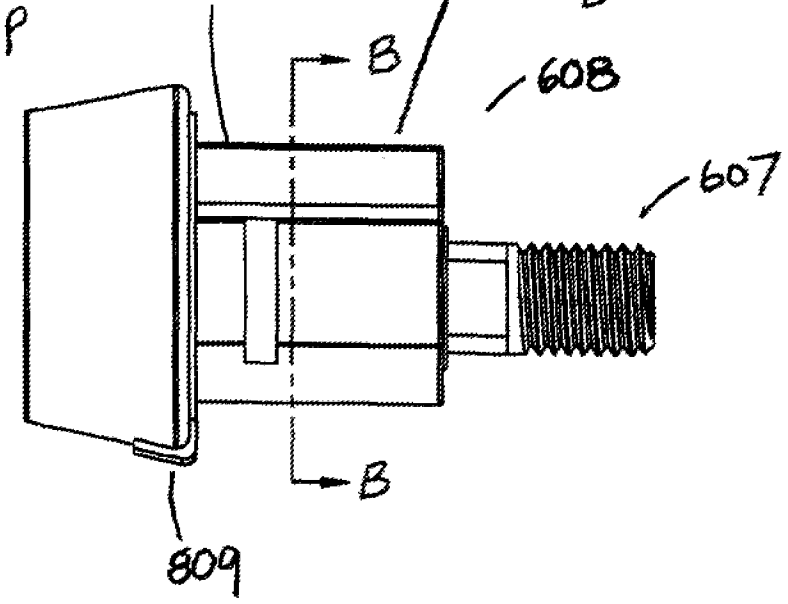

FIG. 12 is a rear view, in perspective, of the bottom of the combined core and shell of FIGS. 10 and 11, viewed from the distal end; and FIG. 13 is a second rear view, in perspective, of the bottom of the combined core and shell of FIGS. 10-12, viewed from the distal end, FIG. 14 is a drawing of an exploded view, in perspective, of the components of another embodiment of the present invention, namely, a wafer lock;

FIG. 15A is a frontal view in perspective of a shell component in the embodiment of FIG. 14;

FIG. 15B is a frontal view in perspective of a rotatable core component in the embodiment of FIG. 14;

FIG. 16 is a partial sectional side view in perspective of a rotatable core and shell combination in the embodiment of FIG. 14;

FIG. 17 is another partial sectional side view in perspective of a key inserted into the rotatable core and shell combination in the embodiment of FIG. 14;

FIG. 18A is a rear view of the rotatable core and shell combination in the embodiment of FIG. 14;

FIG. 18B is a cross sectional side view along the longitudinal axis of the rotatable core and shell combination at section A-A in FIG. 18A;

FIG. 19A is a side view of the rotatable core and shell combination in the embodiment of FIG. 14;

FIG. 19B is a cross sectional view across the longitudinal axis of the rotatable core and shell combination at section B-B in FIG. 19A;

in which the embodiments and certain features are described in more detail below.

DETAILED DESCRIPTION OF CERTAIN EMBODIMENTS OF THE INVENTION

A preferred embodiment of the invention is described below having regard to the example of a tumbler lock as illustrated in FIGS. 4, 5A-5C, and 6A-6C. For applications in which a pin lock of the present invention will be used in retrofit installations, the shell assembly will be configured to match the existing furniture cut-out representing the available space for installation of the replacement lock. In this example, the profile of cylinder 101 is shown as 200 in FIG. 7. It is preferred that the shape of cylinder 208 of the present invention is designed to match the existing profile in the furniture so that the lock can be retrofitted into existing furniture, for example, a storage structure having at least one locking compartment.

Figure 4:
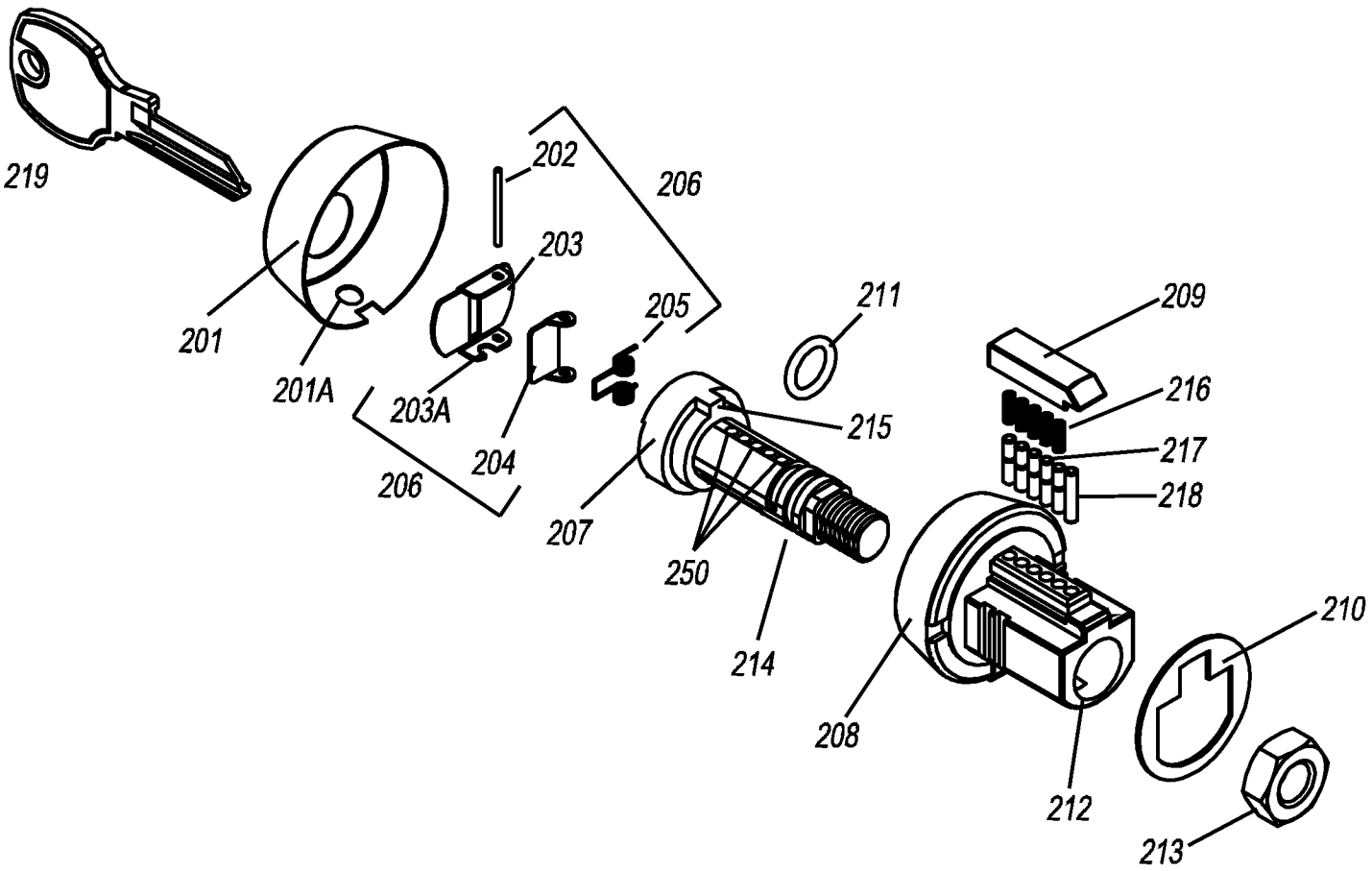
FIG. 4 is a drawing of an exploded view, in perspective, of the components of an embodiment of the present invention, namely, a pin lock.
Figure 6C:
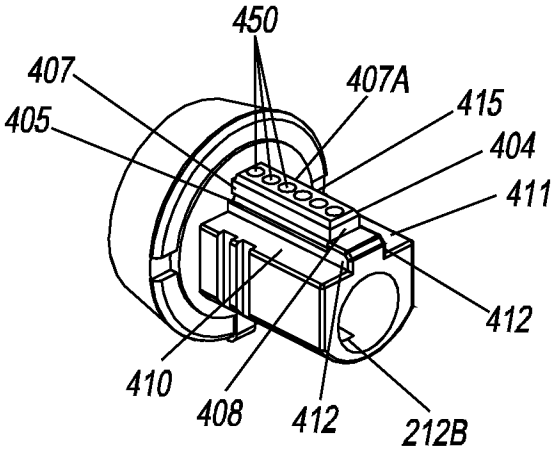
FIG. 6C is a perspective view, from the distal end, of the shell housing of the embodiment of the invention shown in FIG. 4.
Figure 7:
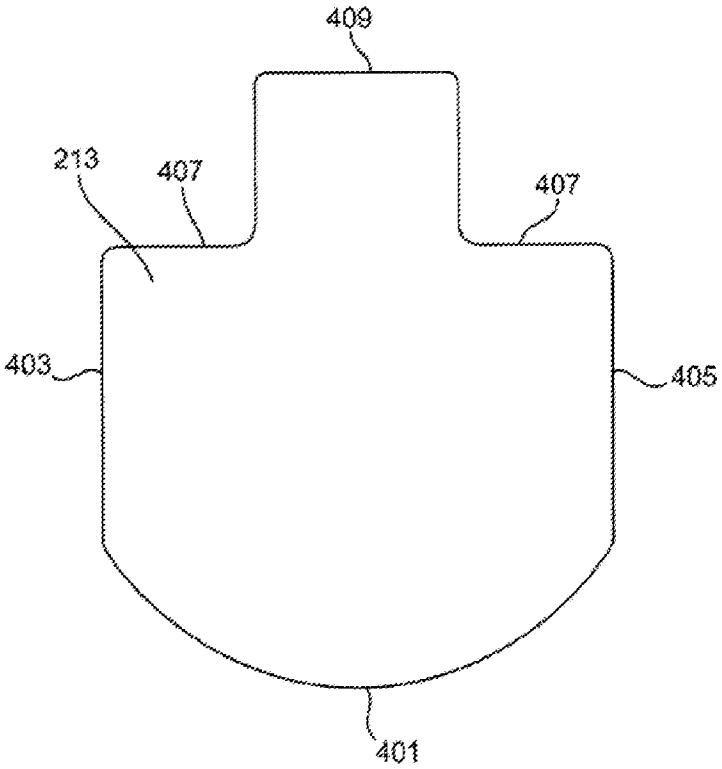
FIG. 7 is a profile view of the distal end of the prior art shell shown in FIGS. 1 and 2.

With reference to FIGS. 4 and 6C, a preferred pin lock of the present invention includes a shell configured as a generally U-shaped cylinder 208 which defines a chamber housing rotatable core 207, preferably made from stainless steel. The shell head 401 of the shell 208 is configured to securely accommodate protective shell scalp 201. The shell 208 is provided with shoulders 410, 411 extending to intermediate edge 412 which defines the transition between the shoulders 410, 411 and vertical sidewalls 407, 407A and vertical end wall 408 joining the sidewalls 407 and 407A. In this embodiment, the elevated pinway is illustrated as a modified pin chamber area 404 configured to accept snug fitting top cap 209. The top edges of sidewalls 407, 407A and end wall 408 are preferably beveled to permit a hood, for example, the top cap 209, to be more easily placed and properly aligned with the elevated pinway during assembly of the preferred pin lock.

Preferably, the top cap 209 is crimped such that a band of the top cap 209 is formed to engage with groove 405 to securely hold the top cap 209 in place, closing the second linear array of pin slots 450, after the crimping operation. The top cap 209 functions as a pin slot closure and a water resistant hood which inhibits water from entering the pin slots 450 and 250 and freezing the pins 217, retaining pin 218, springs 216. The top cap 209 may be made from a suitable material, preferably a metal suitable for the manufacturing process, such as crimping, in the preferred embodiment, and to meet other product specifications.

In other embodiments, the top cap 209 may be configured so that the top cap is fastened to an elevated pinway using another manufacturing technique. For example, the top cap may be press-fit, snap-fit, or slide-fit into place so that a preformed band on the top cap engages a detent on the elevated pinway. By way of further example, the detent may be a ridge or a depression formed on the elevated pinway, preferably adjacent the intermediate edge 412. Upon reading this specification, it will be apparent to persons skilled in the art that other techniques and features may be used to secure a hood to an elevated pinway of the present invention.

In the preferred embodiment of an assembled pin lock, a drainway is provided to channel water outwardly from the interior of the lock so that the water is removed to avoid, for example, freezing which may damage or render the lock inoperable. In the preferred embodiment as illustrated in FIGS. 5B and 6A-6C, the drainway comprises a drainage channel 212 at the bottom of the shell interior which extends from its distal end 212B, toward the proximate end of the shell 208, over drip edge 222. Drainage channel 212 is configured so that water drains from the distal end 212B forward to drain through drainage holes 403, 203A and 201A.

Figure 5C:
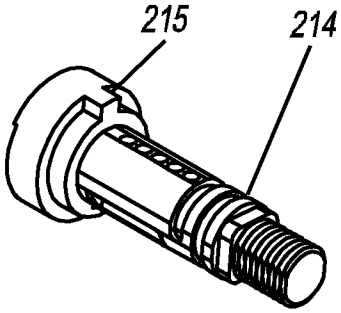
FIG. 5C is a side view in perspective from the distal end of the rotatable core of the embodiment of the invention shown in FIG. 4.
Figure 5B:
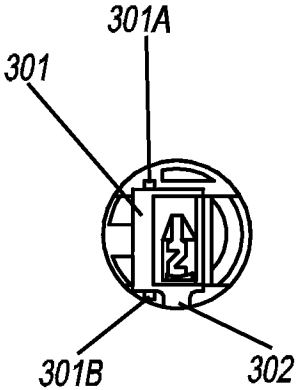
FIG. 5B is a frontal view of the rotatable core of the embodiment of the invention shown in FIG. 4.

As shown in FIG. 5B, a lower cavity 302 is also provided in the proximate face of the rotatable core 207 so that water may vacate more easily away from the keyway, and thus preventing ice build-up behind an access door such as the illustrated dust shutter door 204. Preferably, the lower cavity 302 is positioned so that, when the lock is in the locked position, the lower cavity 302 is positioned above drainage hole 403 and shell drainage hole 201A. The funnel-like shape (with inwardly sloped side walls) and position of the lower cavity 302 below the dust shutter door 204 also creates a gap below the lower edge of the shutter door 204 to permit less restrictive rotational movement of the dust shutter door 204 when it is pushed open with a customer's key 219.

The proximate face of the rotatable core 207 is configured to mount and receive the components of the dust shutter assembly 206. The recesses are adequately shaped and dimensioned to allow the opposite ends of dust shutter pin 202 to engage pin pockets 301A, 301B while supporting dust shutter door 204 and torsional spring 205 within the bracket arms of shutter face plate 203.

The torsional spring 205 is preferably configured as a dual arm spring urging the dust shutter door 204 toward its closed position, to block debris from entering the opening to the keyway when the lock is not being operated with a key 219. The dust shutter pin 202 is preferably round to support the preferred, stronger dual arm torsion spring 205 to improve the closing operation of the dust shutter door 204 particularly when the dust shutter door is impeded by dirt, dust, water or ice. The rounded pin 202 should also rotate more easily even when the dust shutter door or the rounded pin is impeded by dirt or ice.

Figure 5A:
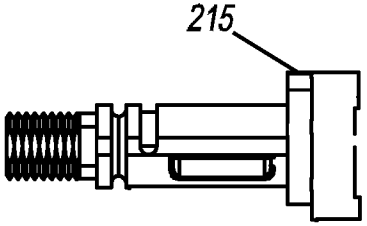
FIG. 5A is a side view of the rotatable core of the embodiment of the invention shown in FIG. 4.
Figure 6B:
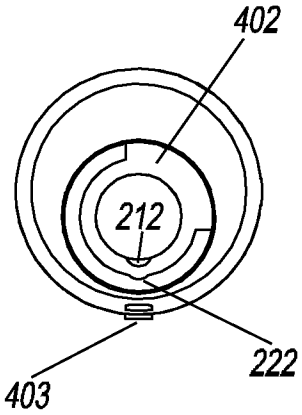
FIG. 6B is a frontal view of the shell housing of the embodiment of the invention shown in FIG. 4 configured for clockwise (CW) rotation of the rotatable core.

It is also preferable to avoid accumulation of any water near the rotational range interface defined by, for example, stop 215 which travels within a rotational track defined by cavity 402 as illustrated in FIGS. 5A and 6B.

Figure 1:
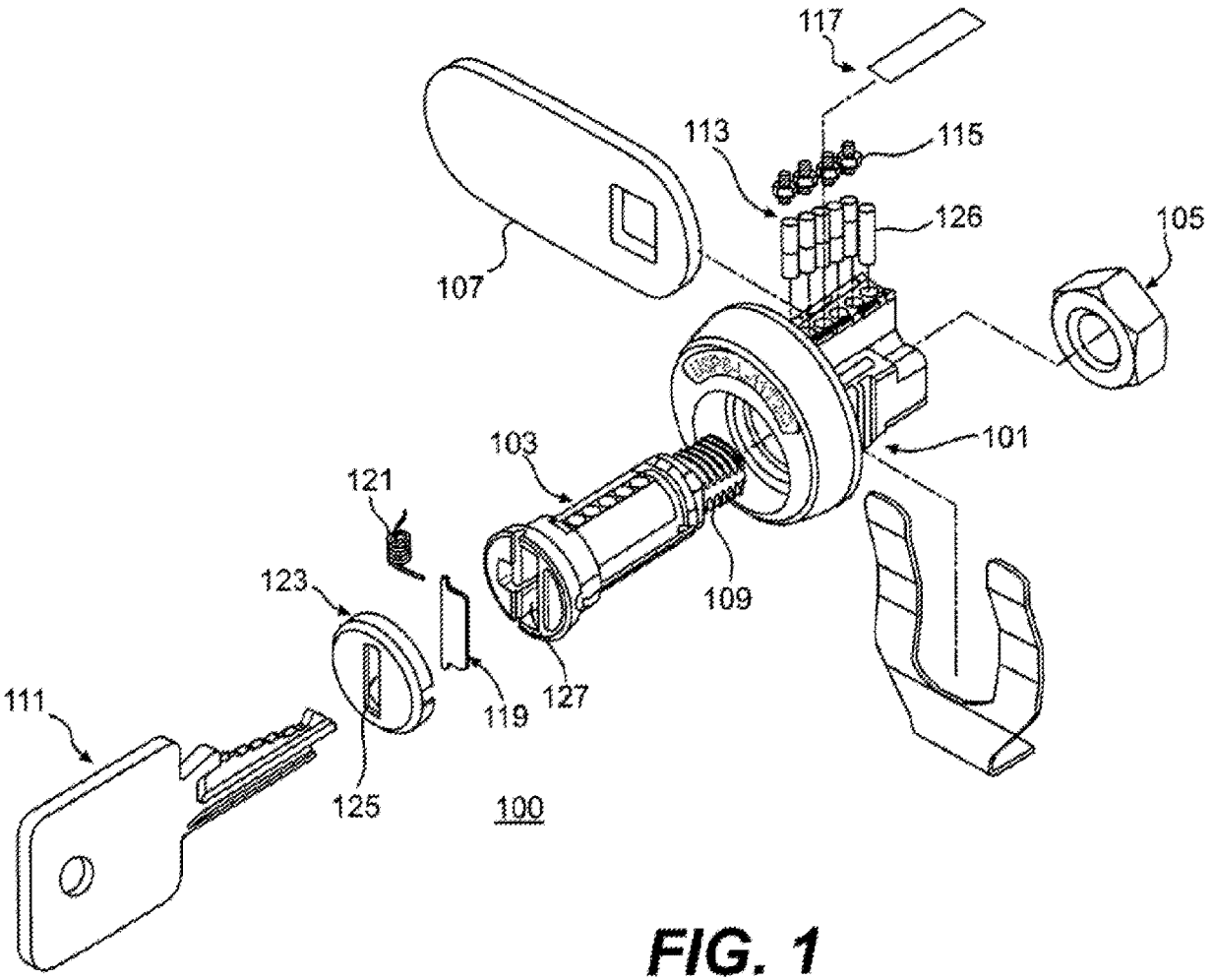
FIG. 1 is a drawing of an exploded view, in perspective, of the components in a prior art pin lock.
Figure 2:
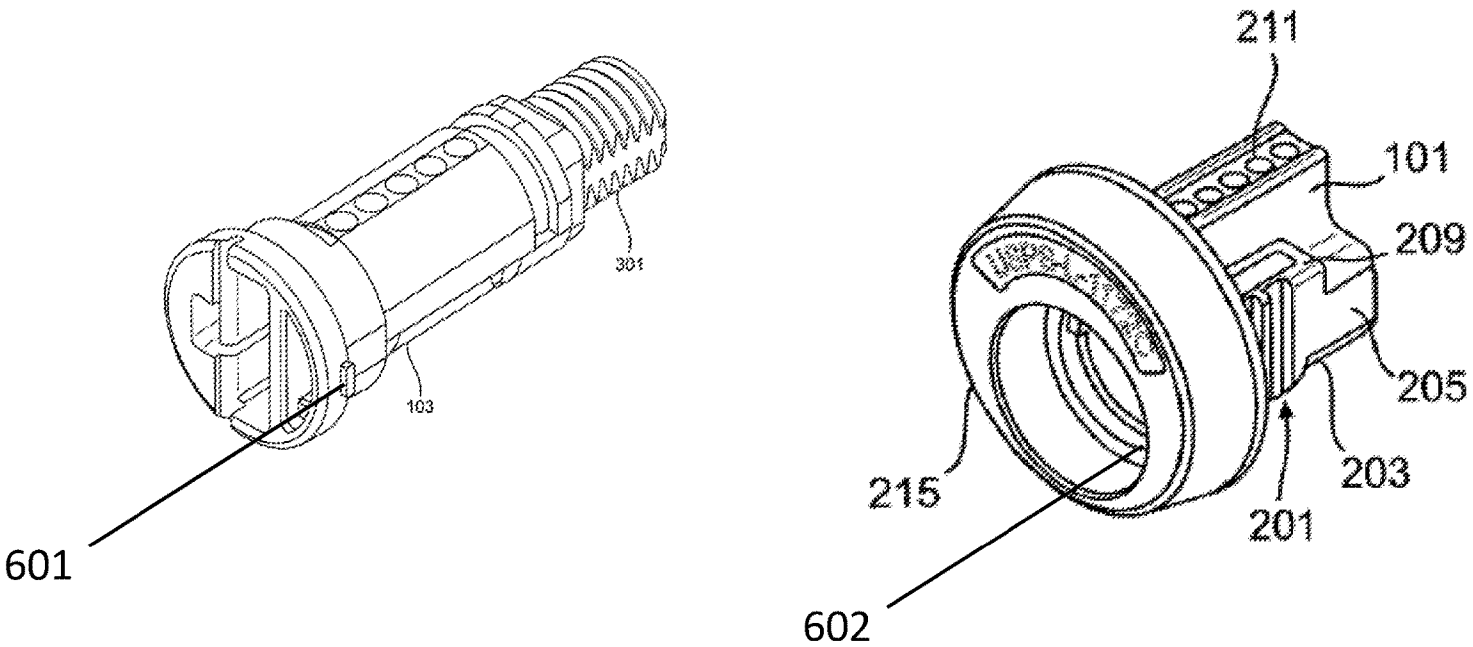
FIG. 2 is a drawing in perspective, showing a core and a shell of the prior art pin lock shown in FIG. 1.
Figure 3:
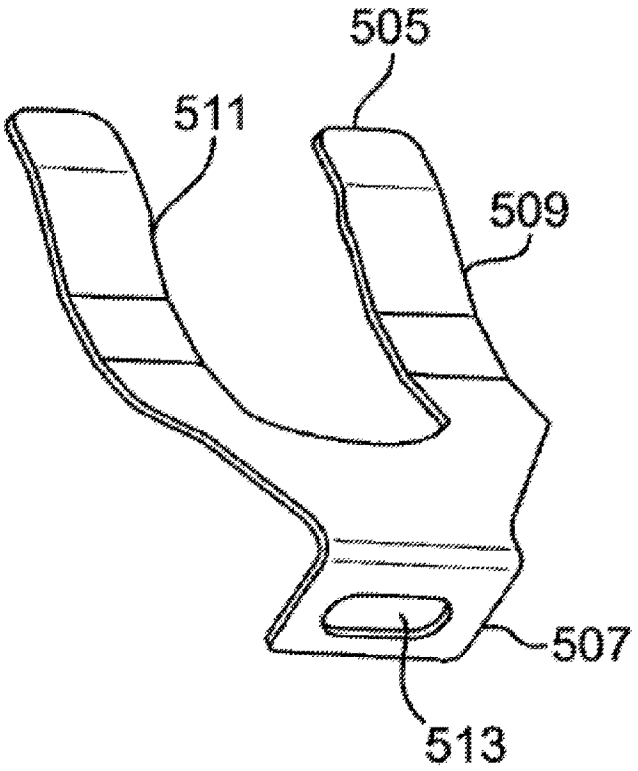
FIG. 3 is a drawing of a perspective view of an enlarged retainer clip 505 provided with the prior art pin lock shown in FIG. 1.

In the prior art pin lock as shown in FIG. 2, stop 601 rotates clockwise from the 3-to-6 o'clock position in stop cavity 602. The stop cavity is near the bottom of cylinder 101. Because of its orientation when the prior art lock is in the locked position, this cavity configuration is prone to buildup of ice adjacent the top of the shell.

Figure 6A:
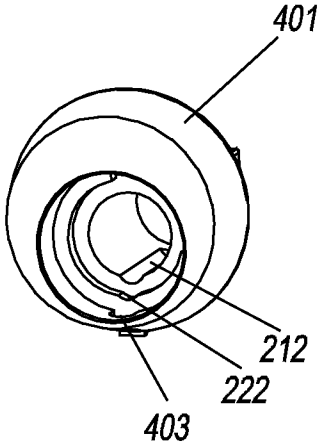
FIG. 6A is a frontal view, in perspective, of the proximate end of the shell housing of the embodiment of the invention shown in FIG. 4 configured for clockwise (CW) rotation of the rotatable core.
Figure 6F:
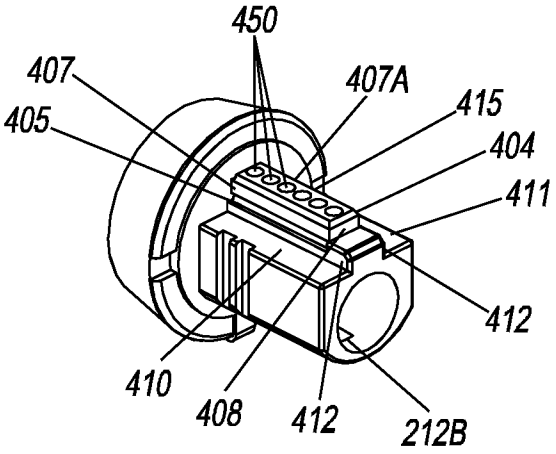
FIG. 6F is a perspective view, from the distal end, of the shell housing of the embodiment of the invention shown in FIG. 6D.
Figure 6E:
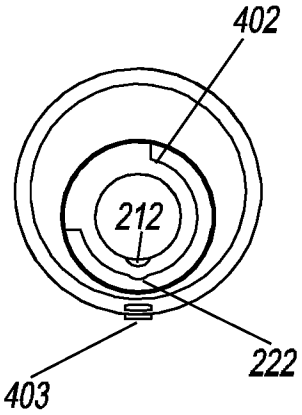
FIG. 6E is a frontal view of the shell housing of the embodiment of the invention shown in FIG. 6D configured for counter clockwise (CCW) rotation of the rotatable core.
Figure 6D:
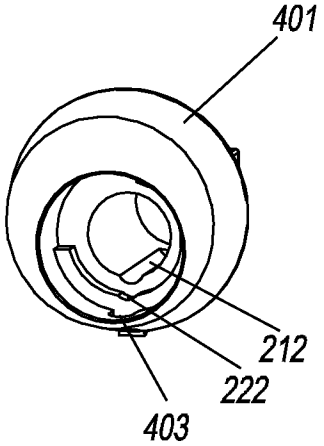
FIG. 6D is a frontal view, in perspective, of the proximate end of the shell housing of the embodiment of the invention shown in FIG. 4 configured for counter clockwise (CCW) rotation of the rotatable core.

In a lock of the present invention designed for clockwise (CW) rotation of the core from a locked to an unlocked position, as illustrated in FIGS. 6A, 6B and 6C, the preferred solution is to move the stop 215 to the 12 o'clock position shown in FIGS. 5A, 5C. In the preferred embodiment of the present invention, the stop 215 rotates clockwise (CW) from a position starting at 12 o'clock and rotating to 3 o'clock. Stop cavity 402 is correspondingly placed at the top of the interior of shell 208 so that ice cannot build up along the interior ceiling of shell 208. In another variant of the invention illustrated in FIGS. 6D, 6E and 6F in which the lock is designed for counter clockwise (CCW) rotation of the core from a locked to an unlocked position, the preferred solution is to provide a configuration in which the stop 215 rotates counter clockwise (CCW) from a position starting at 12 o'clock and rotating to 9 o'clock.

In addition to the preferred drainway which may be provided to drain any penetrating water from within the pin lock, it is also preferable to provide water resistant seals to inhibit the inward flow of rain or other water surrounding the pin lock.

For example, the rotatable core may be lengthened to provide additional mounting space shown as O-ring groove 214 to hold a rubber O-ring 211 as a barrier to inhibit water ingress from the distal end between rotatable core 207 and shell 208. For example, the rubber O-ring 211 may be mounted within O-ring groove 214 prior to assembly.

A shell scalp 201 is shown as a rigid protective shroud to be fastened over the proximate face of the shell 208. The shell scalp is configured to hold the dust shutter assembly 206 in place and to inhibit water ingress from the proximate end, which is often exposed to the elements when the lock is used in outdoor installations. A front gasket 210 may also be added adjacent the proximate end of the pin lock, between the pin lock shell and a surrounding wall of a storage structure such as a lock box. The gasket material is preferably selected to satisfy a product specification for outdoor use. These are only two examples of the various kinds or seals which may be provided to inhibit water ingress.

FIGS. 8-13 illustrate a preferred embodiment of the invention comprising a preferred wafer tumbler lock having a modified stainless steel MIM core 207' which nests, rotatably, within modified shell 208'. The fully assembled wafer tumbler lock preferably has a stainless steel shell scalp 201' which is held in place over the proximate end (face) of the shell 208' by shell scalp retainers 531, 532. The shell scalp 201' may be secured about the shell head by press fit, snap fit, crimping or another suitable method understood by persons skilled in the art.

Figure 8:
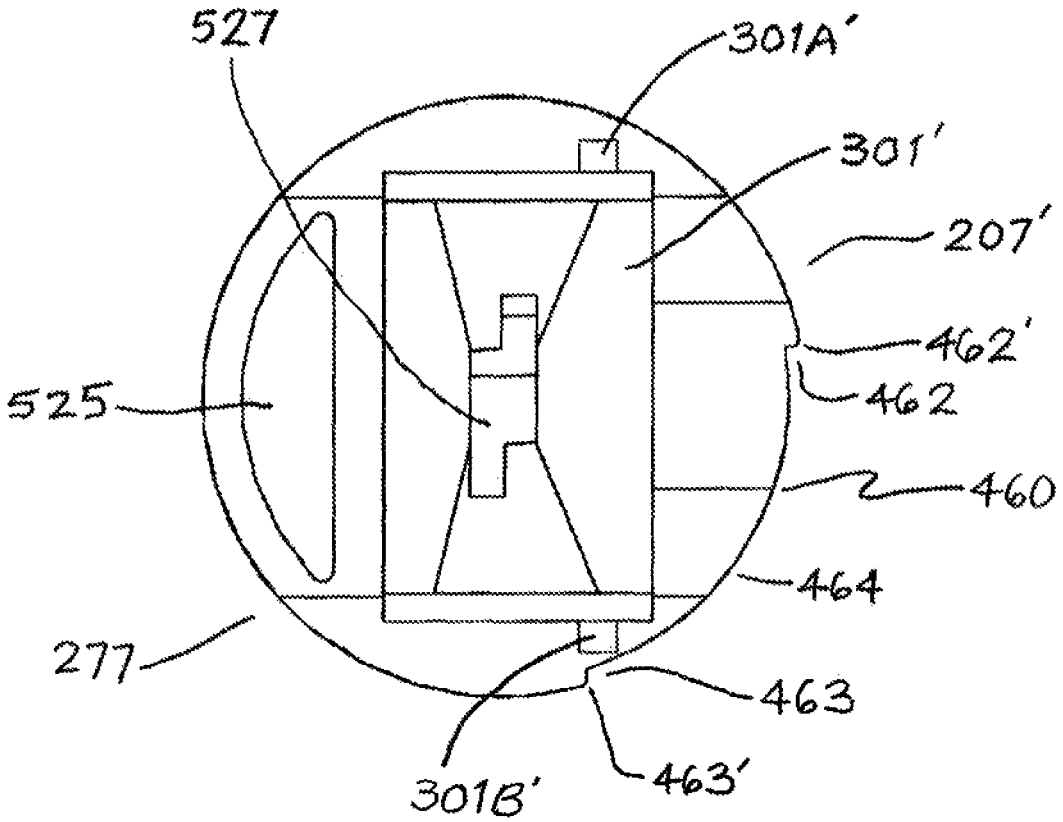
FIG. 8 is a frontal view of the core head of another embodiment of the invention, viewed from the proximate end of the core.
Figure 9:
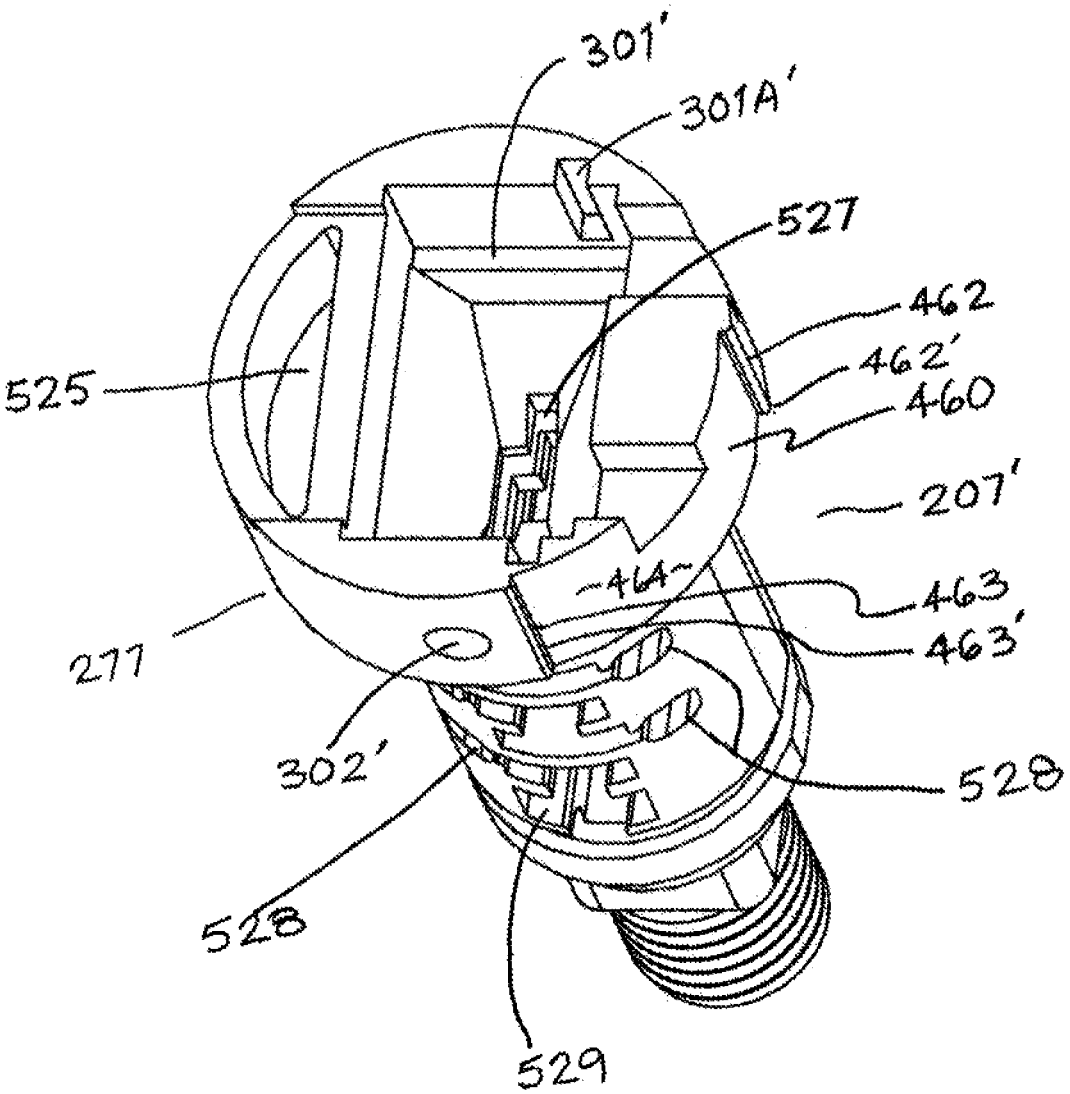
FIG. 9 is a frontal view, in perspective, of the bottom of the core shown in FIG. 8, viewed from the proximate end of the core.

With regard to FIGS. 8 and 9, the core head 277 of core 207' is provided with a dust shutter cavity 301', and pin pockets 301A', 301B' to receive the components of a dust shutter assembly which may be similar to the examples (202-206) shown in FIG. 4. In this embodiment, the core 207' is provided with a plurality of wafer tumbler slots 528 (to receive spring loaded reciprocating wafers which wafers are not shown) and a security retainer wafer (or pin) slot 529 to further inhibit unauthorized tampering, or operation or removal of the core 207'. (However, a security wafer or pin is not shown.)

In this embodiment, the core head 277 is provided with a core head drain hole 302' which is illustrated as being in fluid communication with shell drainage channel 403' which in turn communicates with drainage channel 201A' defined by an opening in the stainless steel shell scalp 201', to provide a drainage outlet to the exterior of the tumbler lock. Preferably, the core head drain hole 302' is positioned to communicate water flow from behind the dust shutter assembly and from other communicating portions of the core, including the opening to keyway 527.

The drainage channel 201A' may include a drip edge 709 such as, but not limited to, an extended lip or protrusion configured to enhance water movement downwardly and outwardly from the interior of the tumbler lock. Preferably, the drip edge 809 is configured to direct water away from the lock and away from any outdoor storage structure in which the lock may be installed.

In some embodiments, the drip edge may also include supplementary ridges or other drip enhancing features provided on shell scalp retainers 531, 532 which have been suitably positioned and configured to promote outward flow of water from within the interior of the tumbler lock, via other portions of the drainway.

In this embodiment, the core head 277 defines a recess 460 extending between recess walls 462, 463 which project outwardly from opposite ends of core head surface 464. When the stainless steel core 207' is inserted within the shell 208', the core head surface 464, recess walls 462, 463 and a concave interior wall of the shell 208' opposing surface 464, define a chamber 465 which includes the space within recess 460. When the tumbler lock is installed and operated by rotational movement of an operating key inserted into keyway 527, the chamber 465 travels along the concave interior wall of the shell 208', taking with it, any debris, including any water or ice which may have accumulated or formed within the chamber 465, for example, when the tumbler lock was in a locked position. Recess shoulders 462', 463' are preferably smoothed, rounded, beveled or otherwise shaped to reduce friction when the core is rotated within the shell 208'. In a preferred embodiment, the chamber 465 will also be in fluid communication with other portions of the drainway, to promote outward flow of water from within the tumbler lock assembly, including when the tumbler lock is in the locked position.

The core head 277 may also include a cavity 525, often, to save MIM material and reduce component weight. Preferably, any cavities within the core 207' or shell 208' will be in fluid communication with other portions of the drainway within the tumbler lock, which may be similar to drainage channel 212, although persons skilled in the art will appreciate, after reading this specification, that other variations and combinations of drainage features may be provided.

In this invention, the drainway may comprise a single fluid pathway or a plurality of fluid pathways to channel fluid flow outwardly and downwardly from the tumbler lock, when the tumbler lock is installed. Where a plurality of fluid pathways are provided, the fluid pathways are preferably interconnected for outward fluid communication between the interior of the tumbler lock and the exterior of the tumbler lock via the drain outlet. The drainway may include a plurality of features (for example, those illustrated and described in FIGS. 4 to 6, and FIGS. 8 to 13 and the related description) to provide a fluid pathway such as but not limited to one or more of the following features to channel outward fluid flow: a conduit, recess, gap, trough, dripway, drip edge, bore, slot, drain opening, drain outlet, and other fluid communication features.

In some embodiments, the drain opening may comprise the drain outlet, a drip edge, dripway or other features to provide or promote fluid egress from the interior of the tumbler lock.

Preferably, the drainway comprises an arcuate recess between the outer surface of the core head and an opposing interior surface of the shell for fluid communication with a drainage opening adjacent the bottom of the proximate end of the shell.

Another embodiment of the invention includes a method of inhibiting water accumulation in a locking system designed for use in a storage structure. The method includes a step of identifying a first shell for use as a substitute tumbler lock having an asymmetrical profile across a longitudinal axis. The first shell comprises a solid waterproof circumferential outer wall extending around the longitudinal axis of the first shell. The first shell is configured for housing a first rotatable locking core. The method includes verifying that the asymmetrical configuration of the first shell corresponds to an asymmetrical profile of a second shell having a top opening in a top surface. The top opening in the second shell is closed with a cap. The first shell and the second shell are suitable for use in the same locking system for the storage structure.

The second shell is configured for housing a second rotatable locking core. The method includes replacing the second shell with the first shell, for aligning engagement with a correspondingly configured mounting recess defined by the storage structure. The first shell and the first rotatable core of the tumbler lock operatively communicate with the locking system.

In another embodiment, the method includes replacing the second shell with the first shell wherein the first shell defines a first chamber with a first cylindrical core profile and the second shell defines a second chamber with a second cylindrical core profile. The first cylindrical core profile may be different from the second cylindrical core profile. For example, the first core profile may include tumblers configured as spring biased wafers which project outwardly from the first rotatable core when the first rotatable core is in its locked position. By way of further example, the different second core profile may include tumblers configured as pins for locking engagement with the second shell having a different internal configuration to accommodate the second core profile.

In another embodiment, the method includes selecting a first shell defining a first chamber for housing the first rotatable locking core. The first rotatable locking core has a first core profile defining a first array of tumblers for engaging an upper recess defined by an upper interior surface of the first chamber. The first rotatable core also defines a second array of tumblers for engaging a lower recess defined by a lower interior surface of the first chamber, opposite the upper recess. The first and second array of tumblers in the first rotatable locking core may be configured as wafers biased for outward projection from the first rotatable locking core when the first rotatable core is in the locked position. The second shell being replaced, may define a second chamber for housing the second rotatable locking core having a different core profile with a third array of tumblers configured as pins biased upwardly and outwardly toward the top opening in the second shell when the second rotatable locking core is in its locked position.

In another embodiment, the method includes providing a drainway comprising a channel in a lower interior wall of the first shell to channel water flow downwardly and outwardly from within the first shell. Preferably, the channel is in fluid communication with a keyway in the first rotatable locking core.

FIGS. 14-19 illustrate another preferred embodiment of the invention. FIG. 14 shows an exploded view of a tumbler lock comprising a shell 608 housing a rotatable core 607 in which the tumblers are configured as lower wafers 618 and upper wafers 718. The upper springs 717 act on their corresponding wafer shoulders **718*a* to urge the upper wafers 718 outwardly from the upper array 750 of wafer slots in the rotatable core toward, and into, the upper channel 712 when the rotatable core 607 is in the locked position. Similarly, the lower springs 617 act on their corresponding wafer shoulders 618*a* to urge the lower wafers 618 downwardly and outwardly from the lower wafer slots 650 in the rotatable core 607 toward, and into, the shell drainage channel 612 when the rotatable core 607** is in the locked position.

At the proximate end P of the tumbler lock, a dust shutter assembly 606 includes a protective SS shell scalp 701 provided as a protective outer cover of the face of the tumbler lock. A SS dust shutter face plate 603 is mounted inwardly of the scalp 701, as a frame to support a SS dust shutter door 604 which pivots on a freely rotatable SS dust shutter pin 702. A dual arm torsional spring 605 urges the dust shutter door 604 toward its closed position, against the inner surface of the dust shutter face plat 603, to inhibit ingress of debris and moisture into the tumbler lock.

Positioned adjacent and inwardly of the distal end D the tumbler lock, an O ring 611 is seated in O-ring groove 614 to inhibit ingress of debris and other contaminants into the interior of the tumbler lock, When the key 619 is inserted into the keyway 627 the upper wafers 718 and the lower wafers 618 are withdrawn from the upper channel 712 and shell drain channel 612, into their respective arrays of wafer slots 750 and 650 to permit rotation of the rotatable core 607 within the defined rotational range.

The shell 608 is configured with an example of an asymmetrical profile defined by the outer shell perimeter 815 as illustrated in FIGS. 14, 18A and 19B extending across the longitudinal axis. In this example, vertical sidewalls 807, 807A extend downwardly in parallel from the top surface 715 of solid rail 713. Vertical end wall 808 extends downwardly from the top surface 715 at the distal end D of the tumbler lock. Exterior shell shoulders 810, 811 extend outwardly from the solid rail 713 as part of the shell perimeter. Shell side walls 813, 813A extend downwardly from their corresponding shell shoulders 810, 811 to join with curved lower shell wall 814, to form a generally "spade-shaped" asymmetrical profile.

The shell 608 defines an interior chamber 865 to house rotatable core 607 for rotation within a defined range, in part determined by stop 615 on the core head 777, the stop 615 moving within a track defined within the interior of the shell 608 (not shown). The core head 777 defines a recess 660 in communication with the drainway and extending between recess side walls 662, 663. Recess shoulders 664, 665 may be beveled or polished, to reduce the risk of binding with the interior chamber wall and to enhance smooth rotational movement of the rotatable core 607. In this embodiment, the recess 660 is also defined by the interior chamber wall 866 and opposing recess surface 661 on core head 777.

In this embodiment, the drainway includes the recess 660 configured on the core head 777, and the shell channel 612 extending toward the proximate end P of the tumbler lock from the distal end 612D of the shell drainage channel 612. At the proximate end P of the keyway 627, the core head 777 defines a core drainage hole 802 which drains into drainage slot 803 defined at the proximate end of the bottom of the shell 608. A drip edge 809 is provided along opposing sides of the shell drainage slot 803.

The tumbler lock may be used as a retrofit replacement (or as an OEM part) for another tumbler lock having a corresponding asymmetrical profile, such as the "spade shaped" profile illustrated in this example. This embodiment which may be used to replace a different lock, for example, the pin lock illustrated in U.S. Pat. No. 9,273,487, having a flat bar crimped into place to seal its opening atop an elevated pinway. In this embodiment of the present invention, the substitute lock may be used to provide improved resistance to water ingress in part due to the waterproof barrier provided at the top of the solid rail 713. The substitute lock is provided with a solid waterproof outer shell perimeter surface 815 extending about and along the longitudinal axis.

In this aspect of the substitute lock, the shell 608 and rotatable core 607 may be configured to provide a different array of tumblers, for example, wafer locks in place of pin tumblers. In one of the preferred aspects, the substitute lock is shown having an upper course of tumblers engaging an upper channel in the shell when the core is in the locked position. This example also shows an opposite lower course of tumblers provided to engage a portion of the drainway extending along a lower interior surface of the shell. In other embodiments, it may be useful to provide yet another, different array of tumblers, and a different channel arrangement for engaging the tumblers with the interior of the shell.

Persons skilled in the art will also appreciate that one or more of the features described in association with one embodiment may be selected for use in other embodiments of the invention, including those other embodiments described herein.

Preferred Materials Choices

While it will be understood that persons skilled in the art will have reasons to select from a wide variety of construction materials, the following materials are preferred for the present invention.

201 Scalp—preferably stainless steel;

206 Dust Shutter Assembly (202-205)—preferably stainless steel;

207 Core—preferably stainless steel, preferably MIM (Metal Injection Molded) hardened to appropriate manufacturing specifications selected for the product installation(s);

208 Shell—preferably cast from zinc;

Hex Nut 105, Retaining Clip 505 are preferably plated in Zinc Nickel Alloy (automotive grade plating) to reduce rusting; and Pins 113 and Retaining Pin 126, or other tumbler configurations and retainers are preferably made of stainless steel.

Preferably, the tumbler lock is treated with lubrication during assembly.

Persons skilled in the art will appreciate that the foregoing description was directed to specific embodiments of the invention. However, many other variations and modifications of the invention are also possible. Preferred embodiments of the invention have been described with regard to the appended drawings. It will be apparent to those skilled in the art that additional embodiments are possible and that such embodiments will also fall within the scope of the appended claims.

Various materials may be used to manufacture the components of the tumbler lock, storage compartments, storage structures and other embodiments of the present invention, as would be evident to a skilled person.

Also, it should be understood that the above-described embodiments of the present invention, particularly, any "preferred" embodiments, are only examples of implementations, which are merely set forth to better understand the principles of the invention. Many variations and modifications may be made to the above-described embodiment(s) of the invention as will be evident to those skilled in the art. Additional embodiments and variations are possible and such embodiments and variations will fall within the scope of the appended claims.

In this document where a list of one or more items is prefaced by the expression "such as" or "including", or is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "having", "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

Nothing in this specification or the claims that follow is to be construed as a promise.

The scope of the claims that follow is not limited by the embodiments set forth in the description. The claims should be given the broadest purposive construction consistent with the description as a whole.

PARTS LIST (OF THE EMBODIMENTS DESCRIBED HEREIN)

In which "SS" indicates stainless steel.

FIGS. 4, 5A-5C, 6A-6F

201—SS Shell Scalp
201A—Shell Drainage Hole
202—SS Dust Shutter Pin
203—SS Dust Shutter Face Plate
203A—Dust Shutter Drainage Hole
204—SS Dust Shutter Door
205—Dual Arm Torsion Spring
206—Dust Shutter Assembly (Shown as 202-205)
207—SS MIM Core
208—Shell
209—Top Cap
210—Front Gasket
211—Rear O-Ring
212—Shell Drainage Channel
212B—distal end of shell drainage channel
213—Hex Nut
214—O-Ring Groove
215—stop
222—drip edge
250—first linear array of pin slots
301—dust shutter cavity
301A—pin pocket
301B—pin pocket
302—lower cavity
401—shell head
402—stop cavity
403—drainage hole
404—pin chamber area
405—groove
407, 407A—vertical sidewalls
408—vertical end wall
410,411—shoulders
412—intermediate edge
415—elevated pinway
450—second linear array of pin slots
601—stop
602—stop cavity
FIGS. 8-13
201' SS shell scalp
201A' shell drainage channel
207' SS MIM core
208' Shell
277 core head
301' dust shutter cavity
301A' pin pocket
301B' pin pocket
302' core head drain hole
403' shell drainage channel
460 recess
462, 463 recess walls 462', 463' recess shoulders
464 core head surface
465 chamber
525 cavity
527 keyway
528 wafer tumbler slots
529 security retainer slot
531, 532 scalp retainers
509 drip edge
FIGS. 14-19
P proximate end
D distal end
603 SS Dust shutter face plate
604 SS dust shutter door
605 dual arm torsion spring
606 dust shutter assembly (603-5, 702)
607 SS MIM core
608 shell
611 rear O-ring
612 shell drainage channel
612B distal end of shell drainage channel
614 O-ring groove
615 stop
617 lower spring
618 lower wafer
618*a* lower wafer shoulder
619 key
650 lower array of wafer slots
660 recess
661 recess surface
662, 663 recess walls
664, 665 recess shoulders
701 SS shell scalp
702 SS dust shutter pin
712 upper channel
713 solid rail
715 rail top surface
717 upper spring
718 upper wafer
718*a* upper wafer shoulder
750 upper array of wafer slots
777 core head
802 core head drainage hole
803 shell drainage slot
807, 807A vertical side walls
808 vertical end wall
809 drip edge
810, 811 shoulders
813, 813A shell side walls
814 shell bottom wall
815 shell perimeter surface

We claim:

1. A tumbler lock for installation in a lock receptacle defining a spade-shaped asymmetrical receptacle profile in a storage structure, the tumbler lock extending along a longitudinal axis from an outer face at a proximate end to a distal end, the outer face defining an outer facial surface, the distal end configured for insertion into the receptacle, the tumbler lock comprising:

a shell extending between the proximate end and distal end for housing a rotatable core comprising a core head at the proximate end, the core head defining a proximate face parallel to the outer facial surface and a circumferential core head wall extending inwardly from the proximate face toward the distal end, the rotatable core extending along the longitudinal axis from the proximate face of the core head to a core body extending from the core head to the distal end, the core head defining a cross sectional diameter greater than a cross sectional diameter defined by the core body, the shell defining an intermediate shell portion between the core head and the distal end, the intermediate shell portion defining a solid circumferential water impermeable outer wall extending about the longitudinal axis, the solid circumferential water impermeable outer wall defining a spade-shaped shell perimeter profile comprising a solid water impermeable top rail extending upwardly from the spade-shaped shell perimeter profile, without an internal array of tumblers projecting inwardly from within the top rail toward the rotatable core, when in a locked position, a single linear array of retractable tumblers extending outwardly from the rotatable core, the single linear array of retractable tumblers comprising a plurality of upwardly projecting retractable tumblers extending into an upper channel within the shell when the tumbler lock is in a locked position, the upper channel extending below the solid water impermeable top rail, the single linear array of retractable tumblers operating within tumbler slots communicating with an operating key when the operating key is inserted into a keyway, to permit rotation of the core about the axis upon retraction of the tumblers into the tumbler slots when the tumbler lock is in an unlocked position, a drainway comprising a drainage channel adjacent a lower interior wall of the shell extending downwardly and outwardly from within the tumbler lock, to channel water ingress adjacent the facial surface downwardly along a lower portion of the proximate face, and to channel said water outwardly from within the tumbler lock, via a drain opening adjacent the proximate end, an interior drainage chamber at the proximate end in water communication with the drainage channel, wherein the drainage interior chamber is defined by a rotatable arcuate recess in a lower quadrant of the circumferential wall of the core head extending from the proximate face of the core head toward the core body, and the recess extending radially about the longitudinal axis from a 3 o'clock position to a 6 o'clock position on the core head or from a 6 o'clock position to a 9 o'clock position on the core head, when the locking core is in the locked position, and the spade-shaped asymmetrical shell perimeter profile being suitable for substitution of a pin tumbler lock intended for installation in the lock receptacle in the storage structure, the pin tumbler lock having a corresponding spade-shaped asymmetrical second shell profile, the pin tumbler lock including a second shell having a perforated top rail with a flat cover insert above an internal array of pin tumblers within the perforated top rail of the second shell.

2. The tumbler lock as claimed in claim 1, the drainage channel comprises (i) a downwardly and outwardly sloped linear recess extending along a bottom surface of the lower interior wall of the shell between the distal end and a drain outlet at the proximate end, and (ii) a vertical channel segment along a lower proximate facial portion of the core head, the vertical channel segment defining a dripway in water communication with the drain outlet.

3. The tumbler lock as claimed in claim 1, the arcuate recess is defined by two opposing sidewalls projecting inwardly from the circumferential core head wall to a bottom recess wall, and a portion of a chamber wall of the round interior cylindrical chamber.

4. The tumbler lock as claimed in claim 1, comprising an annular scalp covering the proximate end of the tumbler lock and holding an O-ring seal between an interior surface of the annular scalp and a proximate face of the shell, the O-ring having a circular cross section and extending in contact about an outer perimeter of a proximate end of the core head, at a rotational interface between the core head and the shell, to inhibit water ingress into the tumbler lock.

5. The tumbler lock claimed in claim 4, further comprising an access door positioned inward of the annular scalp and biased to cover the keyway to inhibit water ingress into the keyway when the keyway is not in use.

6. The tumbler lock claimed in claim 4, an access door positioned inwardly of a central opening in the annular scalp and biased to cover the keyway, the access door is pivotably mounted on a frame defined by the proximate end of the core head, the bottom of the access door defining an elevated bottom edge above an adjacent surface of the core head, the elevated bottom edge defining a clearance gap when the access door pivots above the adjacent surface, the drainway comprises a vertical channel segment along a lower proximate facial portion of the core head, the vertical channel segment defining a dripway opening within a linear drainage slot extending along a lower portion of the shell wall.

7. The tumbler lock claimed in claim 1, the shell defining a first shell having a first interior profile for housing a first rotatable core defining a first cross sectional core profile; and the second shell defining a second interior cross sectional profile different from the first interior cross sectional profile, the second shell housing a second rotatable core defining a second cross sectional core profile different from the first cross sectional core profile.

8. The tumbler lock as claimed in claim 1, the shell defining a first shell for interchangeable replacement of a second shell defining a corresponding asymmetrical cross sectional profile extending across a mid-portion of the second shell, the first shell defining a first interior cross sectional profile for housing a first rotatable core, the first rotatable core defining a first cross sectional core profile; and the second shell defining a second interior cross sectional profile different from the first interior cross sectional profile, the second shell housing a second rotatable core defining a second cross sectional core profile different from the first cross sectional core profile, the second rotatable core being incompatible for operational use in the first shell.

9. A storage structure comprising the tumbler lock claimed in claim 1, the tumbler lock providing locking access to a storage compartment within the storage structure.

10. A method of inhibiting water accumulation in a locking system for use in a storage structure, the storage structure defining a spade-shaped asymmetrical receptacle profile compatible for securing a top accessible tumbler lock shell within the storage structure wherein the top accessible tumbler lock shell comprises a capped plurality of overhead tumbler ports defined by an upwardly projecting hollow top rail and extending from an exterior access to the hollow top rail and projecting inwardly toward a center of the top accessible tumbler lock shell, the method comprising:

selecting a first tumbler lock shell having a spade-shaped asymmetrical exterior profile across a longitudinal axis, the spade-shaped asymmetrical exterior profile being compatible to secure the first tumbler lock shell within the spade-shaped asymmetrical receptacle profile, the first tumbler lock shell comprising an upwardly projecting solid top rail centrally located on a solid waterproof circumferential outer wall extending around the longitudinal axis of the first tumbler lock shell, the first tumbler lock shell defining a downwardly and inwardly sloped interior drainage channel extending along a lower inner wall of the first tumbler lock shell and between a distal end of the first tumbler lock shell and a proximate end of the first tumbler lock shell to drain water from the interior of the first tumbler lock shell, the first tumbler lock shell being configured for housing a first rotatable core, the first rotatable core comprising a core head and defining a first exterior rotatable core profile;

the first rotatable core extending along the longitudinal axis from the core head adjacent the proximate end to a core body extending from the core head to the distal end, the core head defining a cross sectional diameter greater than a cross sectional diameter defined by the core body;

removing a capped top accessible tumbler lock shell from the spade-shaped asymmetrical receptacle profile, the top accessible tumbler lock shell comprising a capped plurality of overhead tumbler ports defined by an upwardly projecting hollow top rail and being configured for housing a second rotatable core defining a second exterior rotatable core profile different from the exterior profile of the first rotatable core, the second rotatable core being incompatible for operational use within the first tumbler lock shell;

replacing the capped top accessible tumbler lock shell with the first tumbler lock shell, for aligning secure engagement of the first tumbler lock shell within the receptacle profile and for operative communication with the locking system;

the core head defining an arcuate recess between an outer circumferential wall of the core head and an opposing interior wall of the first tumbler lock shell in water communication with a drainway outlet, wherein the arcuate recess is in a lower interior quadrant of the first rotatable core, the arcuate recess extending from a 3 o'clock position to a 6 o'clock position or from the 6 o'clock position to a 9 o'clock position when the first rotatable core is in a locked position; and providing a protective annular scalp over a proximate end of the first tumbler lock shell, a bottom edge of the protective annular scalp defining the drainway outlet in water communication with the drainage channel, and a water resistant seal comprising an O-ring positioned at the proximate end and providing a water barrier around the proximate end of the keyway and pressed between the protective annular scalp and the first tumbler lock shell to inhibit water ingress between the proximate end of the first rotatable locking core and the proximate end of the first tumbler lock shell.

11. The method claimed in claim 10, wherein the O-ring having a circular cross section, the O-ring is positioned about the keyway at a rotational interface between the first rotatable core and the first tumbler lock shell to inhibit water ingress into the first tumbler lock.

12. The method claimed in claim 10 comprising:

providing an access door positioned between the annular scalp and the proximate end of the first tumbler lock shell, inwardly of a central opening in the annular scalp and biased to cover the keyway when the keyway is not in use, to inhibit water ingress into the first tumbler lock.

13. A tumbler lock for installation in a spade-shaped asymmetrical receptacle in a storage structure, the tumbler lock comprising:

a first shell defining an elongated body with a spade-shaped asymmetrical perimeter profile and extending along a longitudinal axis between a proximate end and a distal end for housing a first rotatable core, the first shell comprising a solid waterproof circumferential outer wall extending around the longitudinal axis, the circumferential outer wall comprising an upwardly projecting solid water impermeable top rail configured to be unsuitable for housing an internal array of tumblers projecting inwardly toward the first rotatable core, the first rotatable core defining a core head adjacent the proximate end, the first rotatable core defining a first array of tumblers for engaging an interior wall of a chamber in the first shell when the first rotatable core is in a locked position, the first rotatable core extending along the longitudinal axis from the core head adjacent the proximate end to a core body extending from the core head to the distal end, the core head defining a cross sectional diameter greater than a cross sectional diameter defined by the core body, an interior drainway extending downwardly and outwardly from within the tumbler lock, the drainway comprising a channel along the bottom interior of first the shell, and a dripway from the keyway in communication with the channel, the dripway extending along a proximate lower edge of the first shell, for water to flow outwardly via a drain opening, a rotatable arcuate recess within a lower quadrant of the tumbler lock, the recess extending from a 3 o'clock position to a 6 o'clock position or from the 6 o'clock position to a 9 o'clock position when the first rotatable core is in the locked position, the recess defined by an outer circumferential surface of the core head and an opposing interior surface of the shell, the arcuate recess extending between the outer circumferential surface of the core head and the opposing interior surface of the first shell, the arcuate recess being in water communication with the drain opening, the first shell being configured for interchangeable use in place of a second shell housing a second rotatable locking core defining a second array of tumblers for engaging the second shell when the second rotatable core is in a locked position, the second shell having a corresponding spade-shaped asymmetrical exterior perimeter profile comprising a perforated top rail housing a plurality of tumblers projecting inwardly for engagement with the second rotatable core, the plurality of tumblers being covered with a cap on the perforated top rail, the first array of tumblers in the first rotatable core being different from the second array of tumblers, and the first rotatable core is incompatible for operational use in the second shell.

14. The tumbler lock claimed in claim 13, the first array of tumblers in the first rotatable core comprising a lower array of tumblers configured as outwardly biased wafers engaging the channel along the bottom interior of the first shell when the first rotatable core is in the locked position.

15. The tumbler lock claimed in claim 13, the first array of tumblers in the first rotatable core comprising an upper array of tumblers configured as outwardly biased tumblers engaging an upper channel along the top interior of the first shell and below the solid water impermeable top rail when the first rotatable core is in the locked position.

16. The tumbler lock as claimed in claim 13, comprising a water barrier seal configured as an O-ring with a circular cross section seated at the proximate end between an outer face ring and the first shell to inhibit water ingress between the first rotatable core and the first shell, the water barrier seal is seated adjacent a keyway extending longitudinally within the first rotatable core, and the outer face ring configured as an annular scalp covering the proximate end of the first shell.

17. The tumbler lock as claimed in claim 16, the water barrier seal extending about the keyway at a rotational interface between the first shell and the first rotatable core, an access door positioned between the annular scalp and the proximate end of the first shell, inwardly of a central opening in the annular scalp and biased to cover the keyway when the keyway is not in use, to inhibit water ingress into the tumbler lock.

18. The tumbler lock as claimed in claim 17, the annular scalp holding the water barrier seal in contact with the rotational interface, the drainage opening configured as a channel slot along a lower edge of the annular scalp.

19. A storage structure comprising the tumbler lock as claimed in claim 13, manufactured for outdoor use exposed to precipitation and in temperatures occasionally ranging below 0 degrees Celsius.

20. The storage structure claimed in claim 19, is an outdoor community mail box comprising a plurality of individually keyed privately accessible mail boxes.

21. A tumbler lock extending along a longitudinal axis from an outer face at a proximate end to a distal end, the tumbler lock being configured for insertion into a housing recess having a spade-shaped asymmetrical cross sectional perimeter profile in a storage structure, the tumbler lock comprising:

a first shell with a corresponding spade-shaped asymmetrical cross sectional perimeter profile for housing a first rotatable core having a core head adjacent the proximate end, the first shell extending between the proximate end and the distal end, the corresponding spade-shaped asymmetrical cross sectional perimeter profile comprising a water impermeable solid top rail projecting from a water impermeable outer perimeter wall extending about the horizontal axis, the top rail configured to be unsuitable for housing an internal array of tumblers projecting inwardly toward the first rotatable core;

the first rotatable core defining a first exterior rotatable core profile and a linear plurality of tumbler slots communicating with a keyway when an operating key is inserted into the keyway, a first set of tumblers in the linear plurality of tumbler slots in coplanar interfacial alignment along an exterior surface of the first rotatable core, when in an unlocked position, to permit rotation of the first rotatable core, about the axis, within the first shell, and the first set of tumblers being biased outwardly for engagement with an interior surface of the first shell when in a locked position, an interior drainway extending downwardly and outwardly from within the tumbler lock, to channel water outwardly via a drain opening, the interior drainway defining a drainage channel, the first set of tumblers comprising downwardly projecting tumblers in the first rotatable core engaging the drainage channel and upwardly projecting tumblers engaging an upper channel below the solid top rail when the first rotatable core is in the locked position, a drainage space adjacent the proximate end defined by a rotatable arcuate recess continuing from a 3 o'clock position to a 6 o'clock position or from the 6 o'clock position to a 9 o'clock position when the first rotatable core is in the locked position, the arcuate recess extending between an outer surface of the core head and an opposing interior surface of the first shell for fluid communication with the drainway, and the first shell being configured for interchangeable use in place of a second shell, the second shell having the corresponding spade-shaped asymmetrical cross sectional perimeter profile for housing a second rotatable core defining a second exterior rotatable core profile different from a first exterior rotatable core profile defined by the first rotatable core, the first rotatable core being incompatible for operational use within the second shell.

22. The tumbler lock claimed in claim 21, comprising an access door positioned between an annular scalp and the proximate end of the first shell, the annular scalp secured over the proximate end of the first shell, the access door extending across a central opening in the annular scalp and being biased to cover the keyway when the keyway is not in use, to inhibit water ingress into the tumbler lock.

23. The tumbler lock claimed in claim 22, comprising an O-ring with a circular cross section seated at the proximate end between the annular scalp and the first shell, the O-ring extending around the keyway and held in contact with a rotational interface between the first shell and the first rotatable core.

24. The tumbler lock claimed in claim 23, a lower edge of a drain slot below the core drain, the drain slot defines a drip edge along a bottom wall portion of the annular scalp.

25. A storage structure comprising the tumbler lock claimed in claim 21, the tumbler lock providing locking access to a storage compartment in the storage structure.

* * * * *